US006439009B1

(12) United States Patent
Heese et al.

(10) Patent No.: US 6,439,009 B1
(45) Date of Patent: Aug. 27, 2002

(54) DOOR WITH A LOCK AND A PLURALITY OF DOORS WITH CORRESPONDING LOCKS AND A METHOD OF INSTALLATION OF A DOOR WITH A LOCK

(75) Inventors: Armin Heese, Reichshof; Manfred Kampmann, Herdecke, both of (DE)

(73) Assignee: DORMA GmbH + Co. KG, Ennepetal (DE)

( * ) Notice: Subject to any disclaimer, the term of this patent is extended or adjusted under 35 U.S.C. 154(b) by 0 days.

(21) Appl. No.: 09/877,224

(22) Filed: Jun. 8, 2001

Related U.S. Application Data

(63) Continuation of application No. 09/134,661, filed on Aug. 14, 1998, now abandoned, which is a continuation-in-part of application No. PCT/EP97/06990, filed on Dec. 12, 1997.

(30) Foreign Application Priority Data

Dec. 17, 1996 (DE) ..... 196 52 348

(51) Int. Cl.[7] ..... E05B 65/10

(52) U.S. Cl. ..... 70/92; 340/5.2; 70/278.1

(58) Field of Search ..... 70/92, 277, 278.1, 70/278.2; 340/5.1, 5.2, 5.21, 5.24, 5.32, 5.33, 5.52, 5.53, 5.6, 5.54, 5.61, 5.7, 5.72; 341/20

(56) References Cited

U.S. PATENT DOCUMENTS

| | | | | | |
|---|---|---|---|---|---|
| 4,092,527 | A | * | 5/1978 | Luecke | 364/709 |
| 4,890,832 | A | * | 1/1990 | Komaki | 341/23 X |
| 5,144,302 | A | * | 9/1992 | Carter et al. | 341/20 |
| 5,337,043 | A | * | 8/1994 | Gokcebay | 340/825.31 |
| 5,793,355 | A | * | 8/1998 | Youens | 345/157 |
| 5,982,888 | A | * | 11/1999 | Luckeneder et al. | 380/4 |
| 6,064,316 | A | * | 5/2000 | Glick et al. | 340/825.31 |

FOREIGN PATENT DOCUMENTS

| | | |
|---|---|---|
| DE | 4017934 | 1/1992 |
| DE | 29500196 | 5/1995 |
| DE | 19531323 | 4/1996 |
| DE | 29510880 | 7/1996 |
| EP | 0441237 | 8/1991 |
| WO | 880328 | 5/1988 |
| WO | 8910651 | 11/1989 |
| WO | 9209773 | 6/1992 |

OTHER PUBLICATIONS

Türterminals DORMA TL Typenreihe 40, DORMA GmbH + Co. KG.
Rettungswegzentralen DORMA RZ 01 und RZ 11, DORMA GmbH + Co. KG.
Türterminal DORMA TL 62, DORMA GmbH + Co. KG.
Türverriegelung DORMA TV Typenreihe 100, DORMA GmbH + Co. KG.
Steuer–,Anzeige–und Alarmeinrichtungen, DORMA GmbH + Co. KG.
Zusatzmodul DORMA ZM 101, DORMA GmbH + Co. KG.
Zusatzmodul DORMA ZM 102, DORMA GmbH + Co. KG.
Zusatzmodul DORMA ZM 201, DORMA GmbH + Co. KG.
CODIC——die Zutrittskontrolle, die electronische Intelligenz in perfekter Weise mit mechanischem Schutz verbindet, pp. 1–8., DORMA GmbH + Co. KG.
Kommunikationstechnik mit Aufgabenzugewinn, elektrobörse 9 1990.

* cited by examiner

*Primary Examiner*—Suzanne Dino Barrett
(74) *Attorney, Agent, or Firm*—Nils H. Ljungman & Associates

(57) ABSTRACT

A plurality of doors in a structure, wherein each door comprises a locking apparatus and an access arrangement. The access arrangement comprises a housing unit and a plurality of alternatively interchangeable inserts configured to be inserted into said housing unit. The inserts are also configured to permit access through a corresponding door. The inserts are designed to have different access configurations, such as a cylinder lock or an electronic code lock. Differently configured inserts can be interchangeably inserted into the housing to change the access configuration at a corresponding door without having to change the housing.

8 Claims, 21 Drawing Sheets

DOOR WITH A LOCK AND A PLURALITY OF DOORS WITH CORRESPONDING LOCKS AND A METHOD OF INSTALLATION OF A DOOR WITH A LOCK

This application is a continuation of U.S. Application No. 09/134,661, filed on Aug. 14, 1998 and now abandoned, which was a CIP of PCT/EP97/06990, filed Dec. 12, 1997.

BACKGROUND OF THE INVENTION

1. Field of the Invention

The present invention relates to a door or a plurality of doors with a safety emergency open button, in which door or doors inserts can be inserted.

2. Background Information

Prior art U.S. Pat. No. 5,198,643 describes a door with a lock. FIG. 1 of U.S. Pat. No. 5,198,643 shows a locking system or control system of the prior art installed in a door lock as used in a hotel. The door lock is installed on a door. It comprises, in general, a conventional mortise lock installed in the door, an outside doorknob, an inside doorknob, and a lock control system. An external lock plate and internal lock plate are secured about the lock. The lock is provided with a locking means in the form of a conventional retractable latch which is operable by the doorknob shaft which may be actuated directly by the inside doorknob or may be operated through the lock control system by the outside doorknob. The lock also includes a deadbolt which is actuable by a deadbolt handle on the inside of the door through the dead bolt shaft. Also, as provided in the conventional lock, the dead bolt is retracted concurrently with the retraction of the bolt by actuation of the inside or outside doorknob.

Such security terminals are used in the form of a compact device that can be installed in emergency exits in environments where access is monitored.

One example of a similar known security terminal is the one that is marketed under the name DORMA TL-40. In a stationary housing installed in the vicinity of a barrier, there is a profile cylinder as defined in DIN 18 252. The housing is attached to a base that is firmly anchored on the wall. An emergency open button is provided with a shatterproof protective cover made of plastic to prevent an unintentional actuation.

An authorized person inserts his or her key into the profile cylinder lock, whereby the "unsecured" operating condition is initiated and the barrier can be opened. Following a specifiable period of time, the security terminal is automatically reset to the "secured" operating status. In the event of an emergency, the protective cover can be broken by a strong blow, which simultaneously with breaking the protective cover presses the emergency open button, and the barrier can be opened without resistance, although an alarm is simultaneously tripped.

In large structures, it is frequently necessary to monitor authorized access on many doors or barriers. In the known security door terminals as described above, this monitoring is performed by means of the safety emergency open button, whereby authorized access always requires the insertion of the key.

The installation and interconnection of different systems with one another requires special adaptations and increases the amount of labor required.

On the other hand, however, the use of security door terminals with safety emergency open buttons is essential, because even in secure areas, the existence of safe escape routes must be essentially guaranteed.

German Laid Open Patent Application No. 40 17 934 describes a device for the wireless polling of information from a response station, in which the response station is provided with the necessary energy by the wireless polling signal from a polling station. The data transmission is capacitive, whereby the energy can be transmitted by capacitance or inductance.

There is a need for a security door terminal that can be used universally in all areas of a secure building where different individual requirements must be met.

OBJECT OF THE INVENTION

The object of the present invention is to create a security terminal with an emergency open button, which terminal can be used throughout the building for all sorts of applications, regardless of the access level, and which represents an improvement over successful known devices.

SUMMARY OF THE INVENTION

The object of the present invention can be accomplished by a door terminal with a housing that is mounted on a mounting base, a profile cylinder insert inside the housing, and a safety emergency open button which is covered by a protective cover, whereby the emergency open button is in communication with a switching module for the release of a locking device, and whereby there is an electronic circuit, the wiring of which is laid out so that various interchangeable modular inserts to control access authorization can be inserted in the housing by means of plug-in connectors.

A device of the type claimed by the present invention reduces both the numbers of parts that must be kept in inventory by the manufacturer or the supplier, as well as the time, cost and complexity of installation in the building in question. The security door terminals also have a uniform external appearance. All of the wiring in the building in question can be realized in the form of standard wiring, which means that there is no need for special adaptations to the building on account of the requirement for functionally different access systems.

On the basis of the organization of the desired access levels in the context of the access philosophy, the devices can be used in modular fashion or individually, whereby the installation of the installation base remains identical on all the doors. In particular, the modification work that has to be performed during the restructuring measures can also include a reorganization of the locally based access authorizations. Such an expense is significantly reduced by the invention, because if a modification is required, all that is necessary is to change the insert. The housing and the wiring are affected not at all, because the individual modular inserts are provided with corresponding plug-in connectors which make possible an immediate modification of a base terminal.

The invention can be used particularly easily to create a security access control system in which, for example, an existing profile cylinder insert is replaced by a round cylinder insert or key reader for a mechanical key in connection with an electronic code lock or a keypad with-an electronic code lock, or a contactless access control system, e.g. one that employs the transponder principle. All the inserts can have the same or similar dimensions, so that the base unit of the terminal remains unchanged.

A log can also be kept of all the door movements of the doors for which access is to be controlled, on the basis of the user's user identification.

The present invention relates to a security barrier terminal with a safety emergency open button, in which modular interchangeable inserts can be inserted in a base module by means of plug-in connectors.

The above discussed embodiments of the present invention will be described further hereinbelow with reference to the accompanying figures. When the word "invention" is used in this specification, the word "invention" includes "inventions," that is, the plural of "invention." By stating "invention," the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below, with reference to possible embodiments which are illustrated more or less schematically in the accompanying drawings, in which:

FIG. 12A–6E are schematic diagrams illustrating embodiments of door terminals with different inserts, each with plug-in connectors;

DESCRIPTION OF THE PREFERRED EMBODIMENT

The parts that are identical or similar in all the drawings are identified by the same reference numbers.

Figure 1:
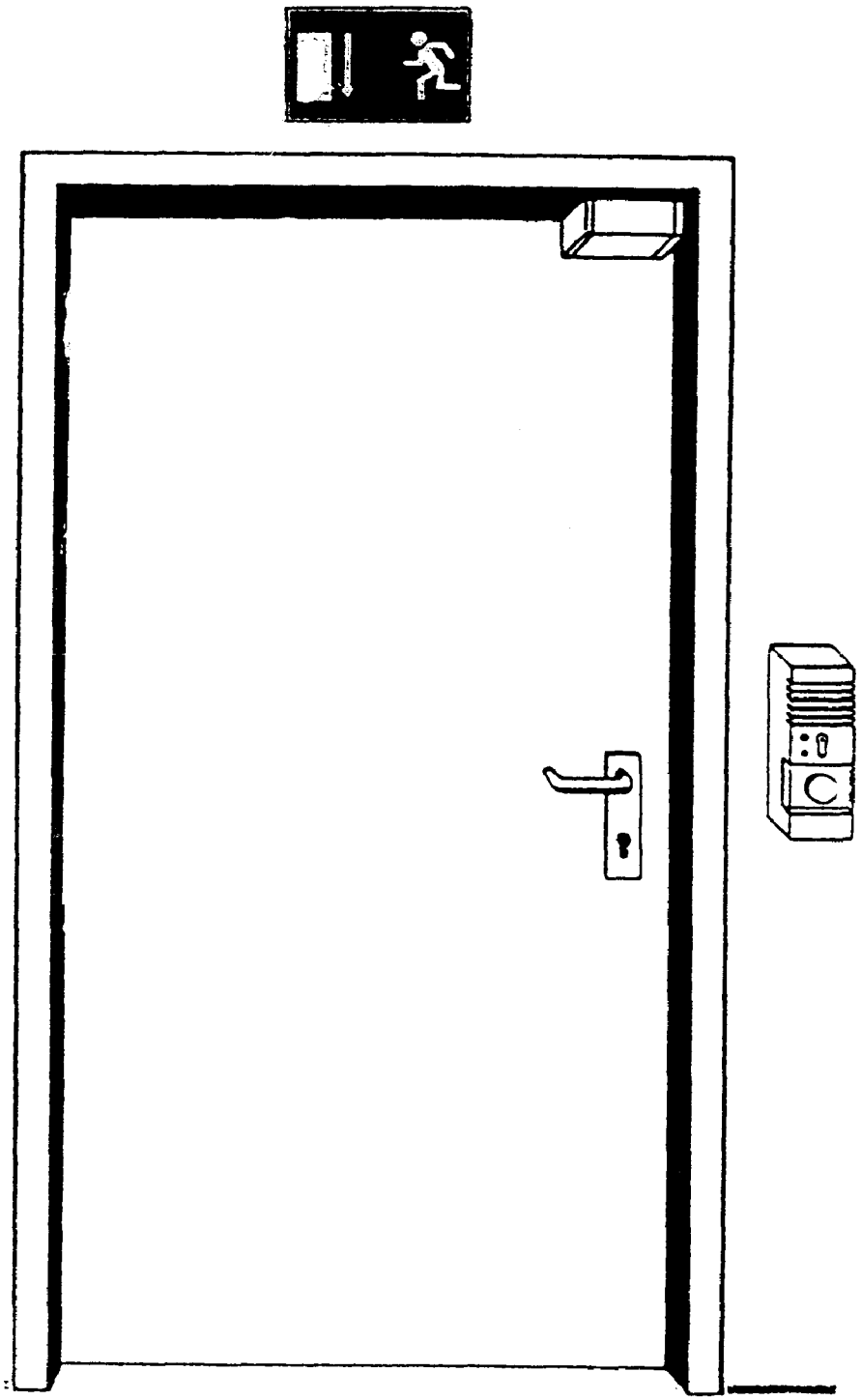
FIG. 1 shows a door into which a possible embodiment of the invention may be incorporated.
Figure 1A:
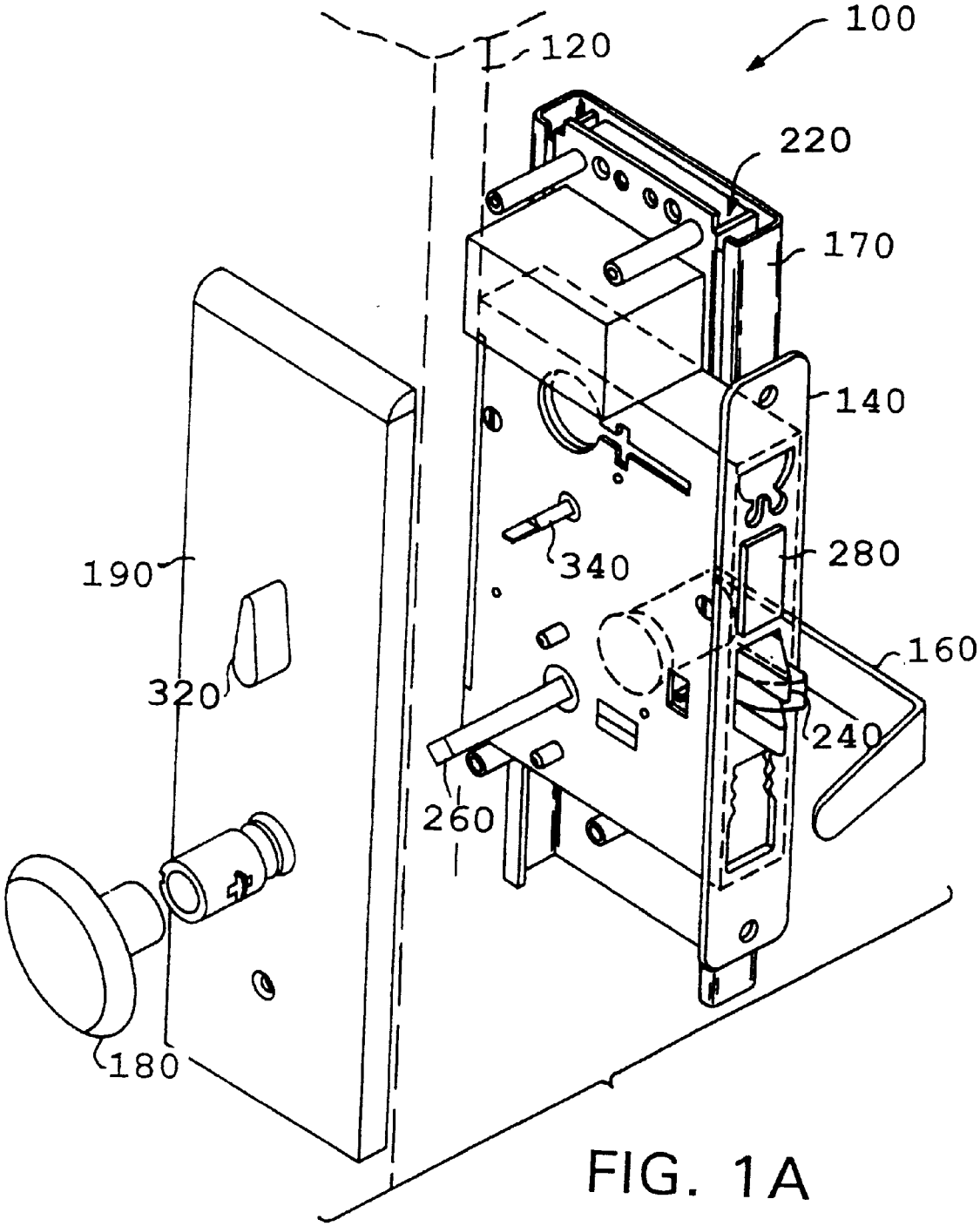
FIG. 1A shows a door with a lock.

FIG. 1A shows a door with a lock as shown in prior art U.S. Pat. No. 5,198,643 FIG. 1. FIG. 1A shows a locking system or control system of the prior art installed in a door lock as used in a hotel. The door lock 100 is installed on a door 120. It comprises, in general, a conventional mortise lock 140 installed in the door 120, an outside doorknob 160, an inside doorknob 180, and a lock control system 220. An external lock plate 170 and internal lock plate 190 are secured about the lock 10. The lock 10 is provided with a locking means in the form of a conventional retractable latch 24 which is operable by the doorknob shaft 26 which may be actuated directly by the inside doorknob 180 or may be operated through the lock control system 220 by the outside doorknob 160. The lock 100 also includes a deadbolt 280 which is actuable by a deadbolt handle 320 on the inside of the door through the dead bolt shaft 340. Also, as provided in the conventional lock 140, the dead bolt 280 is retracted concurrently with the retraction of the bolt 240 by actuation of the inside or outside doorknob. For purposes of clarification only, the figure numbers as originally shown in U.S. Pat. No. 5,198,643 have been changed by the addition of the number "0" to the end of each original figure number to distinguish these figure numbers from the figure numbers in the other drawings in the present application.

FIG. 1 shows a door into which a possible embodiment of the invention may be incorporated.

Figure 2:
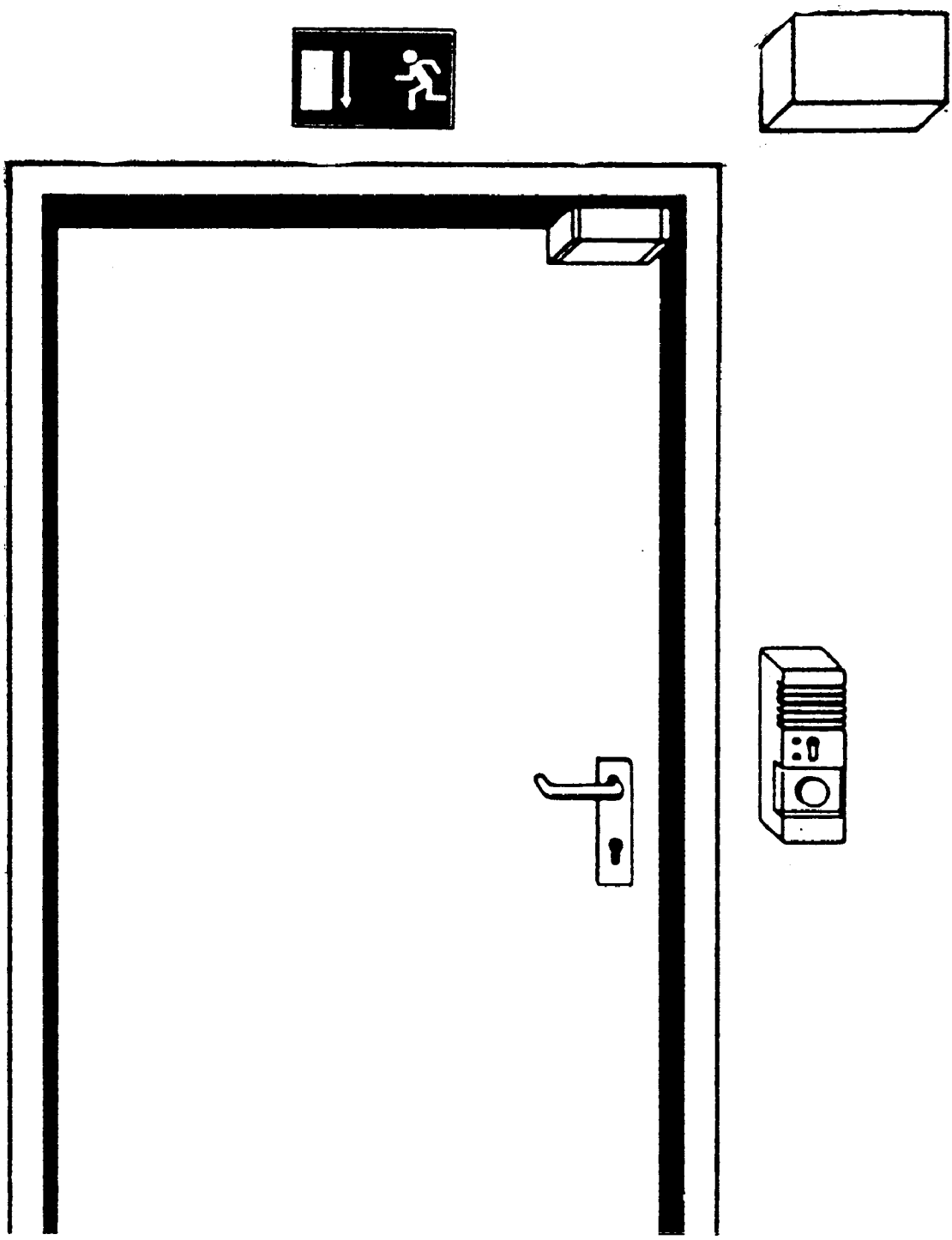
FIG. 2 shows a door into which another possible embodiment of the invention may be incorporated.

FIG. 2 shows a door into which another possible embodiment of the invention may be incorporated.

Figure 3:
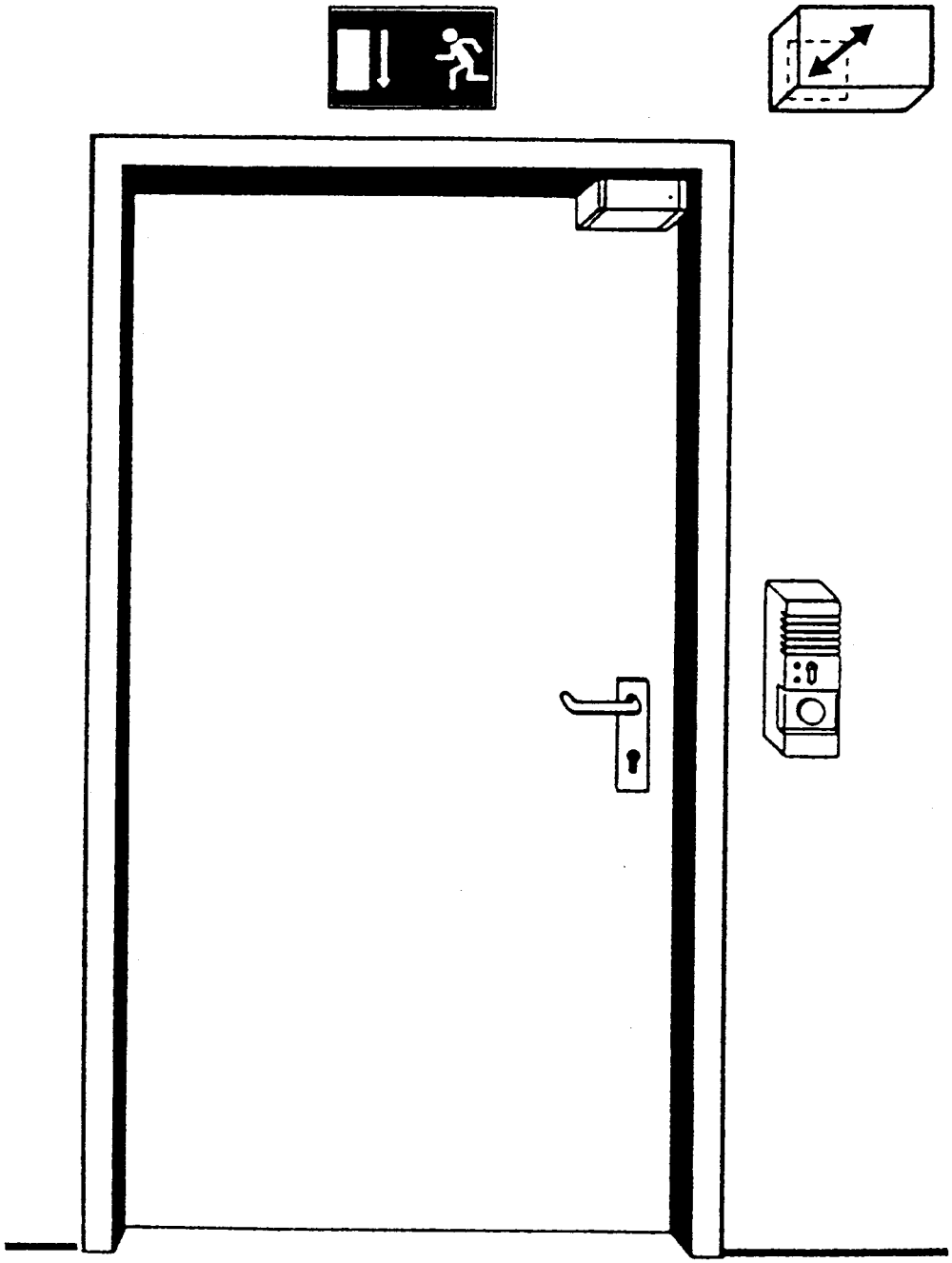
FIG. 3 shows a door into which yet another possible embodiment of the invention may be incorporated.

FIG. 3 shows a door into which yet another possible embodiment of the invention may be incorporated.

Figure 4:
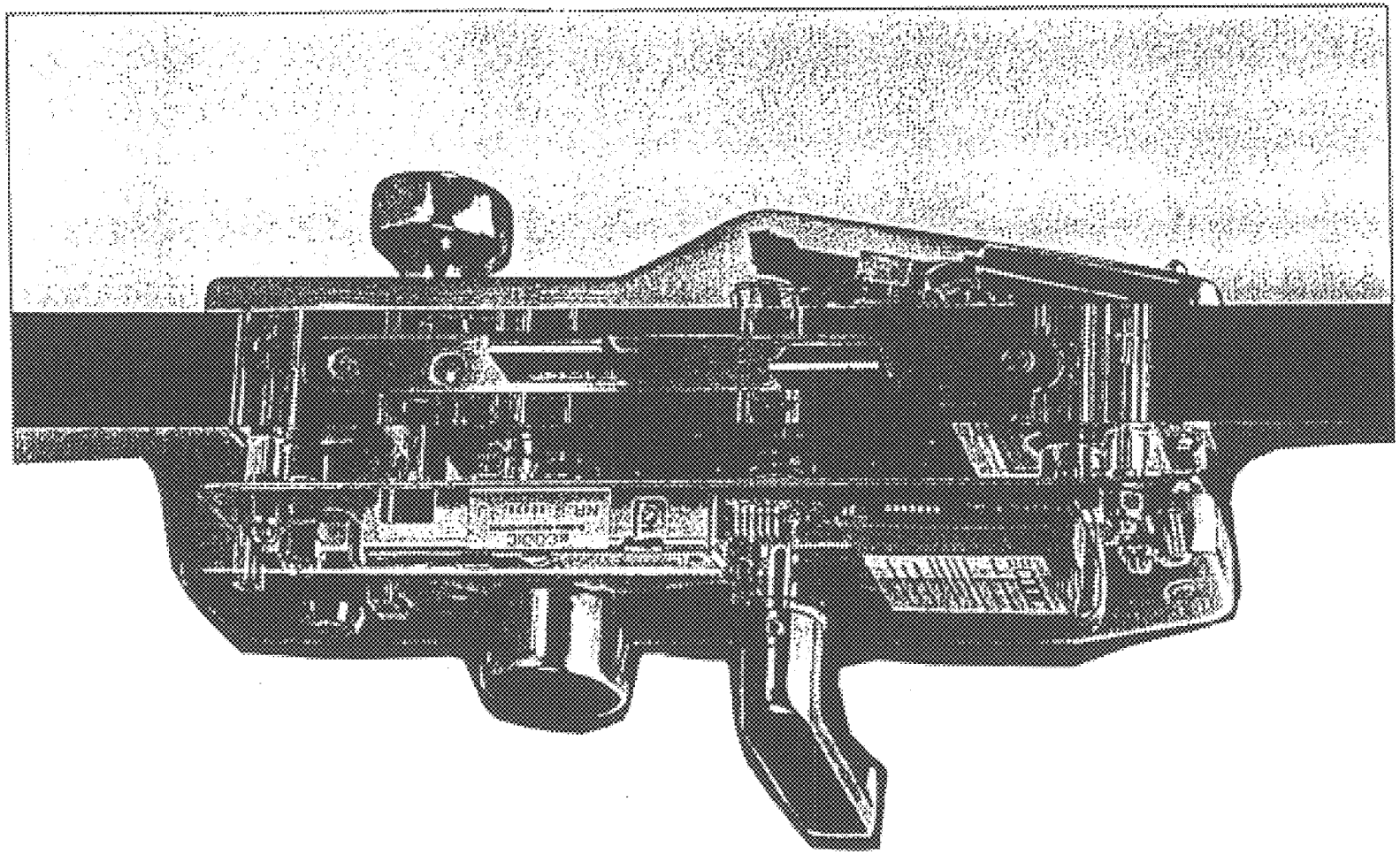
FIG. 4 shows a door with a lock into which still another possible embodiment of the invention may be incorporated.

FIG. 4 shows a door with a lock into which still another possible embodiment of the invention may be incorporated.

Figure 5:
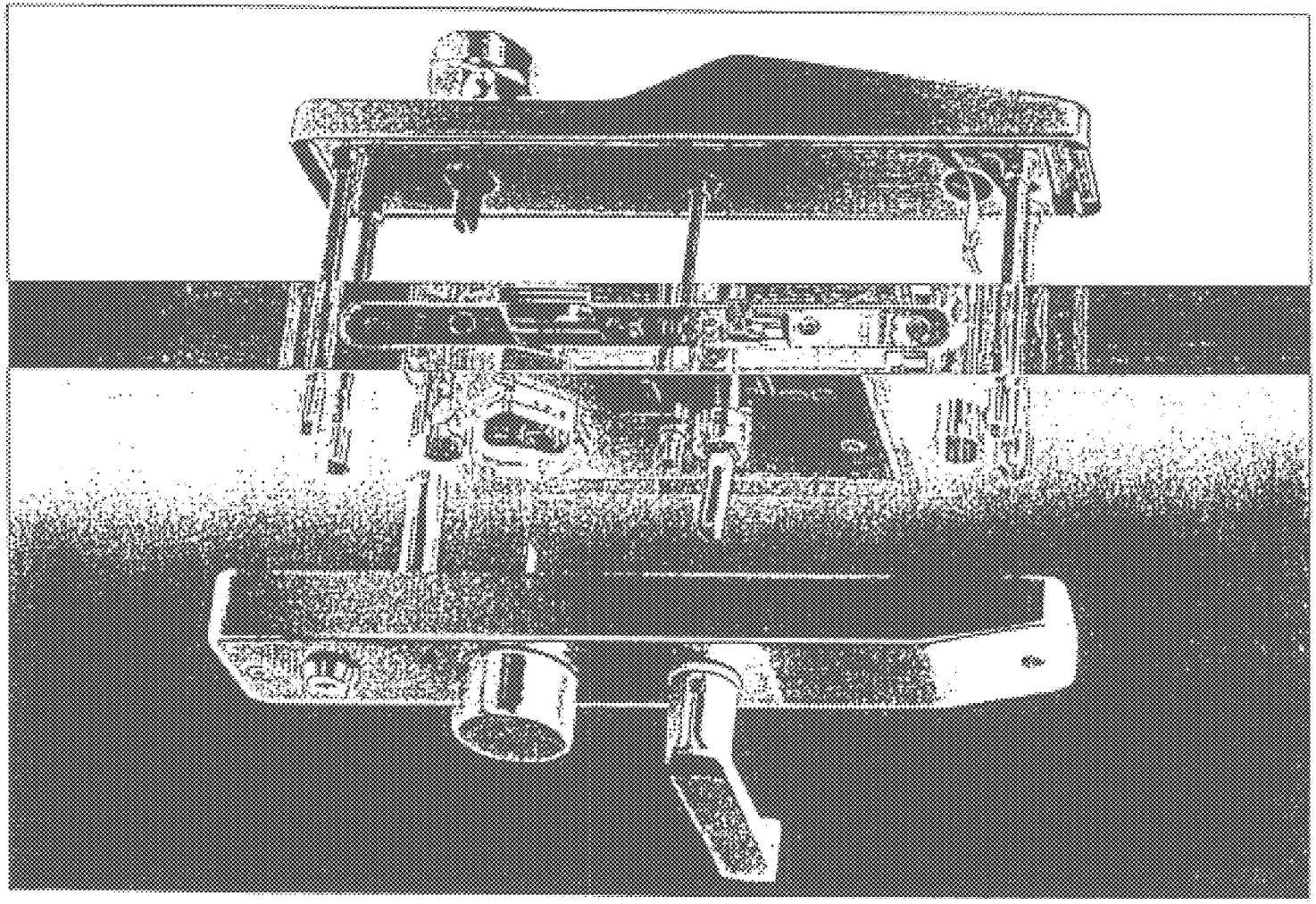
FIG. 5 shows a door with a lock into which a further possible embodiment of the invention may be incorporated.

FIG. 5 shows a door with a lock into which a further possible embodiment of the invention may be incorporated.

Figure 6:
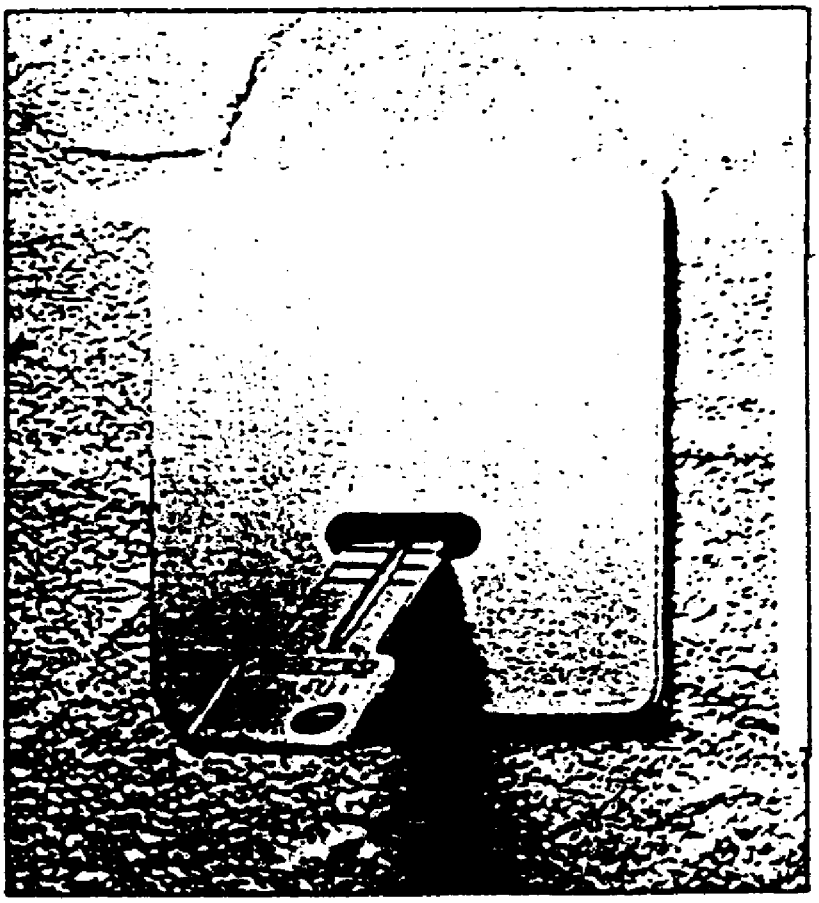
FIG. 6 shows a door with a lock into which a yet further possible embodiment of the invention may be incorporated.

FIG. 6 shows a door with a lock into which a yet further possible embodiment of the invention may be incorporated.

Figure 7:
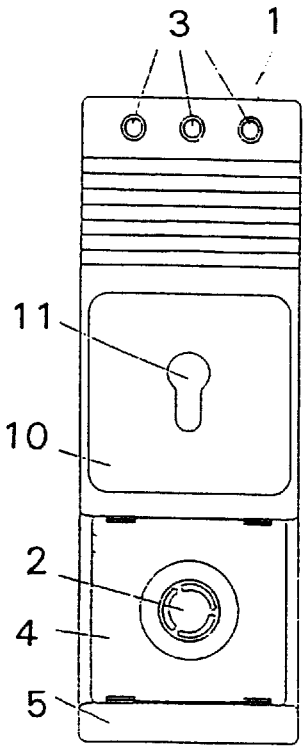
FIG. 7 illustrates a first embodiment of a door terminal with a profile cylinder insert.

FIG. 7 illustrates one possible embodiment of a basic structure of a door terminal 1. In a housing 5 that is installed in a stationary manner in the vicinity of the door, there is an insert 10 that has a profile cylinder 11 that is used to respond to an alarm and to release/disarm the door lock. Integrated into the housing 5 there are also light-emitting diodes 3 to indicate whether the operating status is "secured," "unsecured" and "active." Also installed in the housing 5 are a siren, which is not shown in the illustration, and an emergency open button 2, along with the forced-opening switching module (not shown) as defined-by VDE 0660. The housing 5, which is attached to a heavy-duty base that can be positively and non-positively connected to the wall, can be protected by means of a tamper-proof contact. The emergency open button 2 is protected against unintentional actuation by means of a non-shattering protective cover 4 preferably made of plastic.

A person with authorized access inserts his or her key into the profile cylinder 11, whereupon the "unsecured" operating status is initiated and the door can be opened, because there is a release of the locking device on the door. After a specified length of time, the electronic system of the terminal switches back to the "secured" operating status, and once the door has been closed it cannot be reopened. The function of the emergency open button remains unchanged.

That is to say, in at least one embodiment of the present invention the invention can include a safety emergency open button 2 which is covered by a shatter-resistant protective cover 4, whereby the emergency open button 2 is in communication with a switching module for the release of a locking device, and whereby there is an electronic circuit, the wiring of which is laid out so that various interchangeable modular inserts-to control access authorization can be inserted in the housing by means of plug-in connectors. Further, in the event of an emergency, the protective cover over the emergency open button 2 can be broken by a strong blow, which blow can simultaneously press the emergency open button, and the door can be opened without resistance, although an alarm can be simultaneously tripped.

Figure 8:
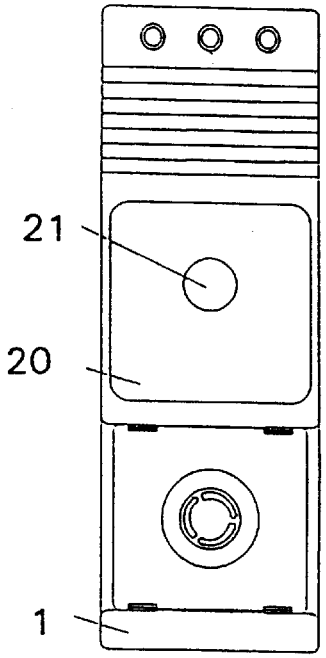
FIG. 8 illustrates an embodiment of a door terminal with a round cylinder insert.

If necessary, the insert 10 with the profile cylinder 11 can be replaced by an insert 20 that is provided with a round cylinder 21, as illustrated in FIG. 8.

Figure 9:
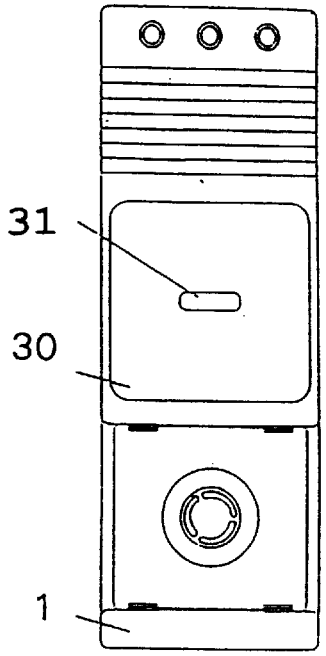
FIG. 9 illustrates an embodiment of a door terminal with a key reader.

Depending on the desired access philosophy—and as illustrated in FIG. 9—an insert 30 can also be realized in the form of an insert containing an electronic code lock 31 that can be opened by a mechanical code key.

Figure 10:
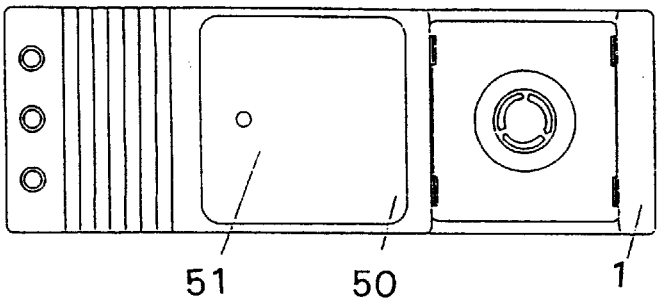
FIG. 10 illustrates an embodiment of a door terminal with a keypad.

If the access philosophy eliminates the use of keys or mechanical code keys, the housing 5 can be equipped with an insert 40 or 51 that has a keypad 41 for an electronic code lock, as illustrated in FIG. 10.

To further explain, in one embodiment, the housing 5 can be equipped with an insert 40, which insert 40 can have an electronic code lock 41 that is opened by a keypad.

It is also possible to use an insert 51 for a contactless access control system, in which the door is opened when it receives the coded sensor signal.

Figure 11:
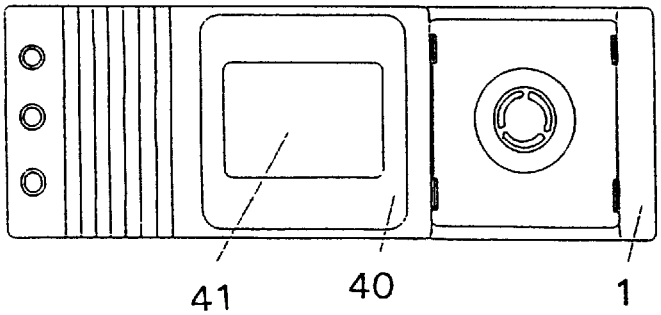
FIG. 11 illustrates an embodiment of a door terminal with a contactless access control system.
Figure 12A:
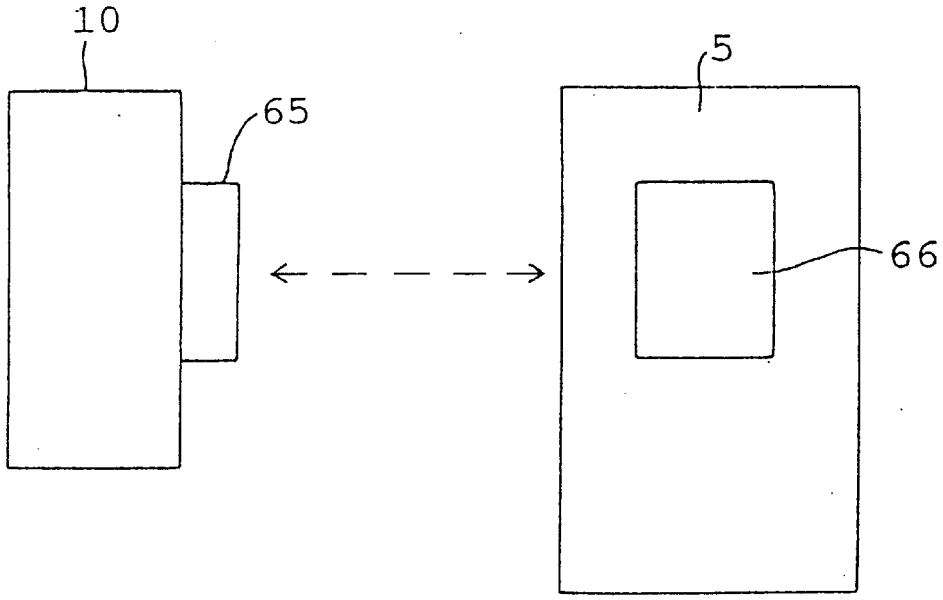
Figure 12B:
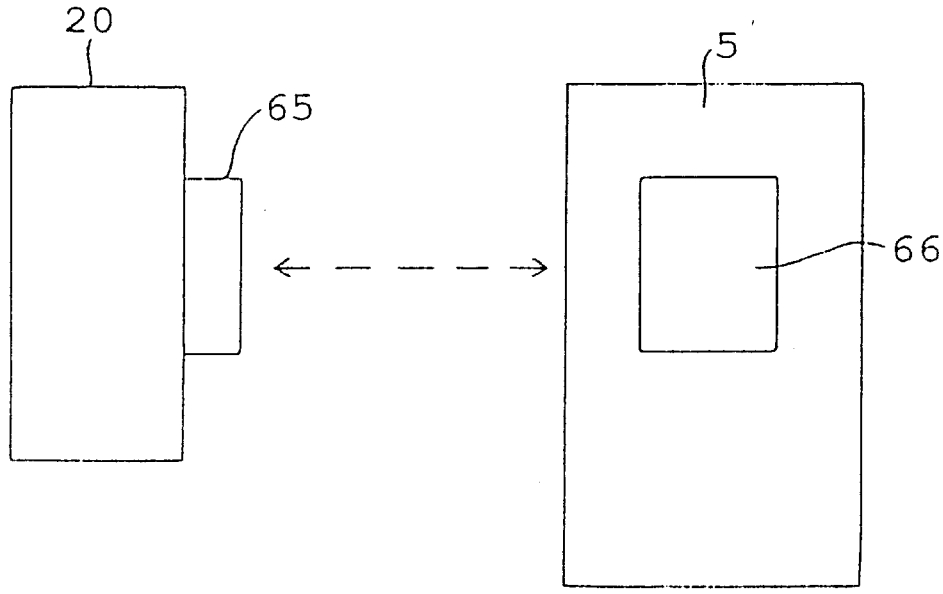
Figure 12C:
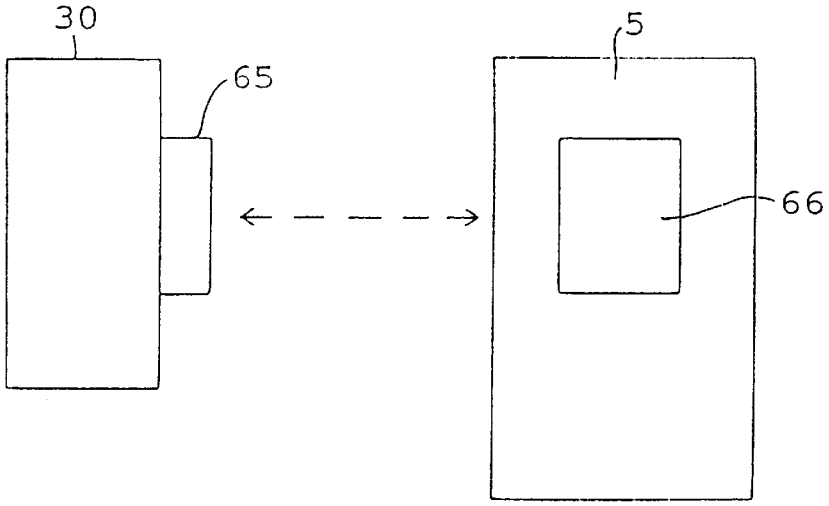
Figure 12D:
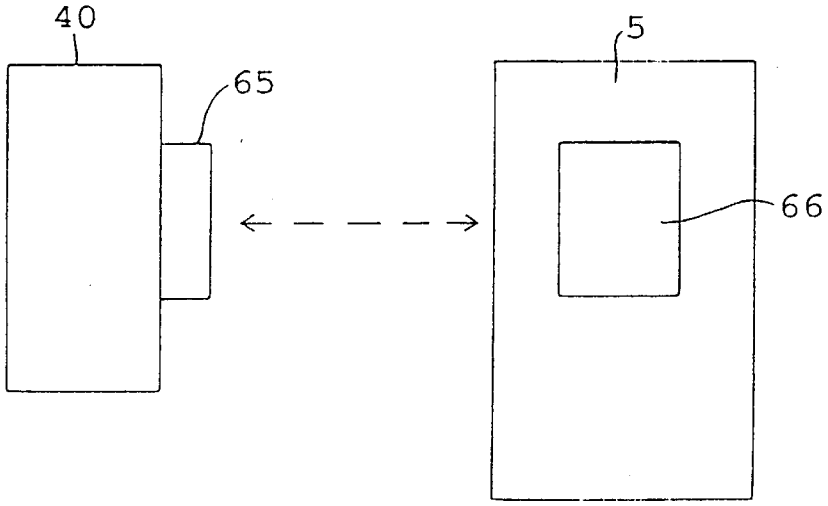
Figure 12E:
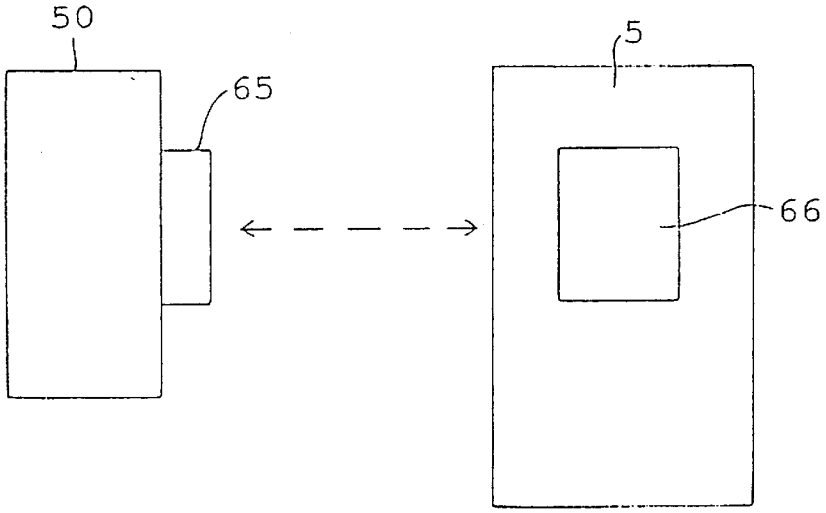

To further explain, as shown in FIG. 11, in one embodiment an insert 50 can have a sensor system 51 that can be based on transponder technology, wherein the door is opened when it receives the coded sensor signal.

The housing 5, which can be designed for wall-mounted or recessed installation, is thereby realized so that all of the connections required for the operation of the individual inserts are present, and so that these inserts can be interchanged and replaced by one another in modular fashion by authorized personnel.

In at least one embodiment of the invention, as schematically shown in FIGS. 12A–12E, the plug-in connector could possibly include a plug-in unit 65 located on or in the back side of the insert 10. This plug-in unit 65 could, for example, include one or more plug pins. These plug pins could be configured to fit into insertion openings in a corresponding socket unit 66 located on or in the housing 5. It is also possible, in another embodiment of the present invention, for the socket unit 66 to be located on or in the insert 10, and the plug-in unit to be on or in the housing 5. It is also possible in at least one possible embodiment of the invention that more than one type of plug-in unit and corresponding socket unit might be utilized in the present invention. To explain, for example, different housing inserts 10, 20, 30, 40, 50 might possibly have differently designed plug pins or different numbers of plug pins, and the base unit 5 could thus be designed to accommodate a variety of plug pin arrangements. Further, the plug-in unit 65 could, for example, have contact areas or strips which correspond to matching contacts within the socket unit 66 (see FIG. 14A), wherein it is possible that each of the different inserts 10, 20, 30, 40, or 50, could possibly have different contact areas or a different combination of areas depending upon which of the contacts in the socket unit 66 that particular insert needed to contact in order to complete the appropriate circuit or circuits needed for utilizing the specific insert. In this manner the housing 5, which can be designed for wall-mounted or recessed installation, is thereby realized so that essentially all of the connections required for the operation of the individual inserts are present, and so that these inserts can be interchanged and replaced by one another in modular fashion by authorized personnel. In one embodiment of the present invention, it could also be possible that a housing 5 could be configured to receive more than one insert 10, 20, 30, 40, 50 at the same time.

Figure 13A:
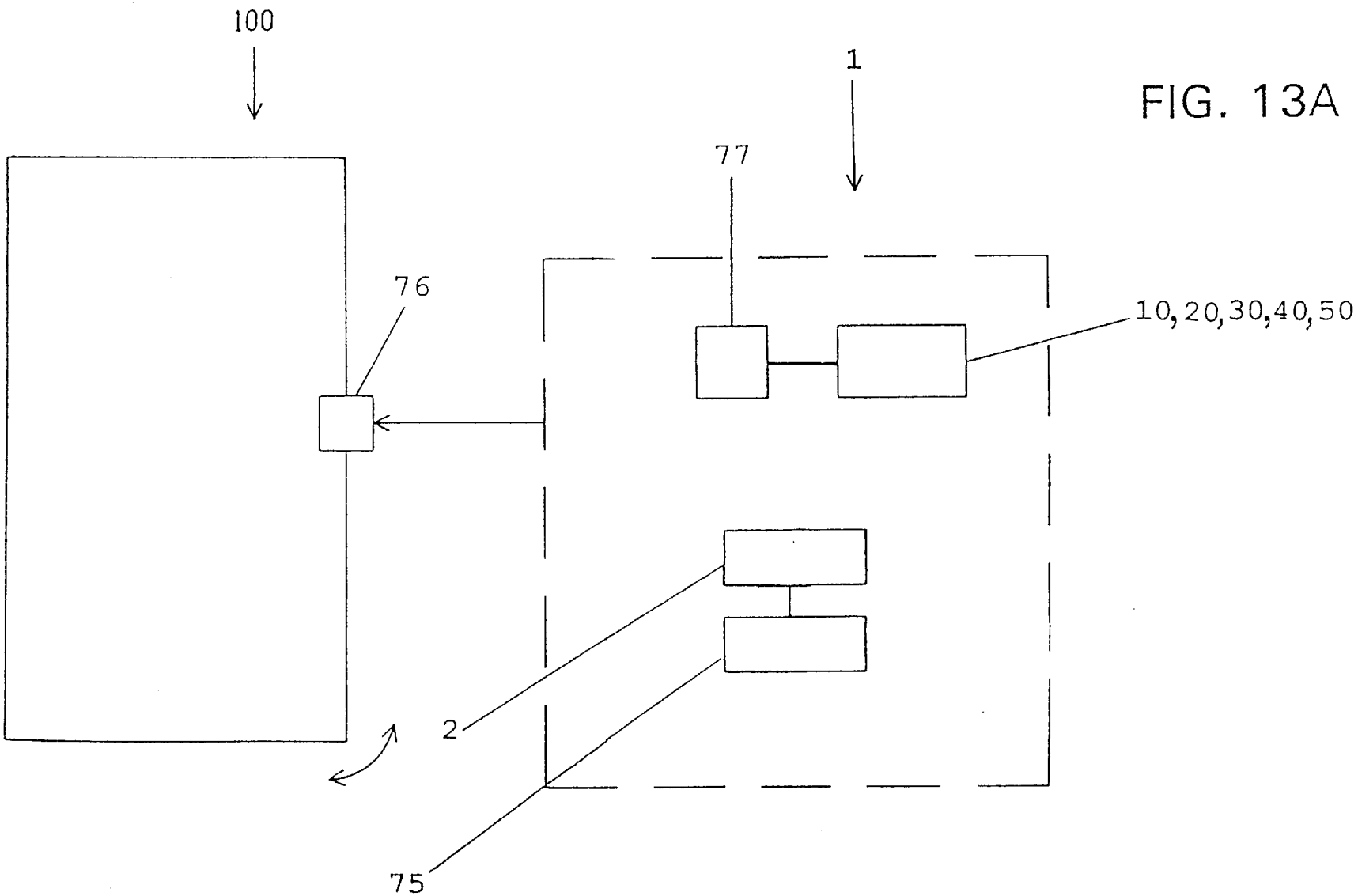
FIG. 13A shows a schematic illustration of a possible security arrangement.

FIG. 13A is a schematic illustration showing one possible. security arrangement and the relationship between several possible components, wherein a barrier or door 100 is locked and unlocked by locking apparatus 76, which locking apparatus can be controlled by the door terminal 1, in accordance with the present invention. As shown, the emergency open button 2 is in communication with a switching module 75, which switching module 75 can release the locking apparatus 76. In at least one embodiment, this switching module 75 can be a forced-opening switching module which is located within the housing 5 (it is also possible for this switching module be located outside of the housing 5). An electronic circuit 77 can be designed so that various interchangeable modular housing inserts 10, 20, 30, 40, 50 can be inserted by means of plug-in connections to allow access to authorized persons. It is also possible that in one embodiment of the present invention the housing inserts 10, 20, 30, 40, 50 could be in communication with the switching module 75.

Figure 13B:
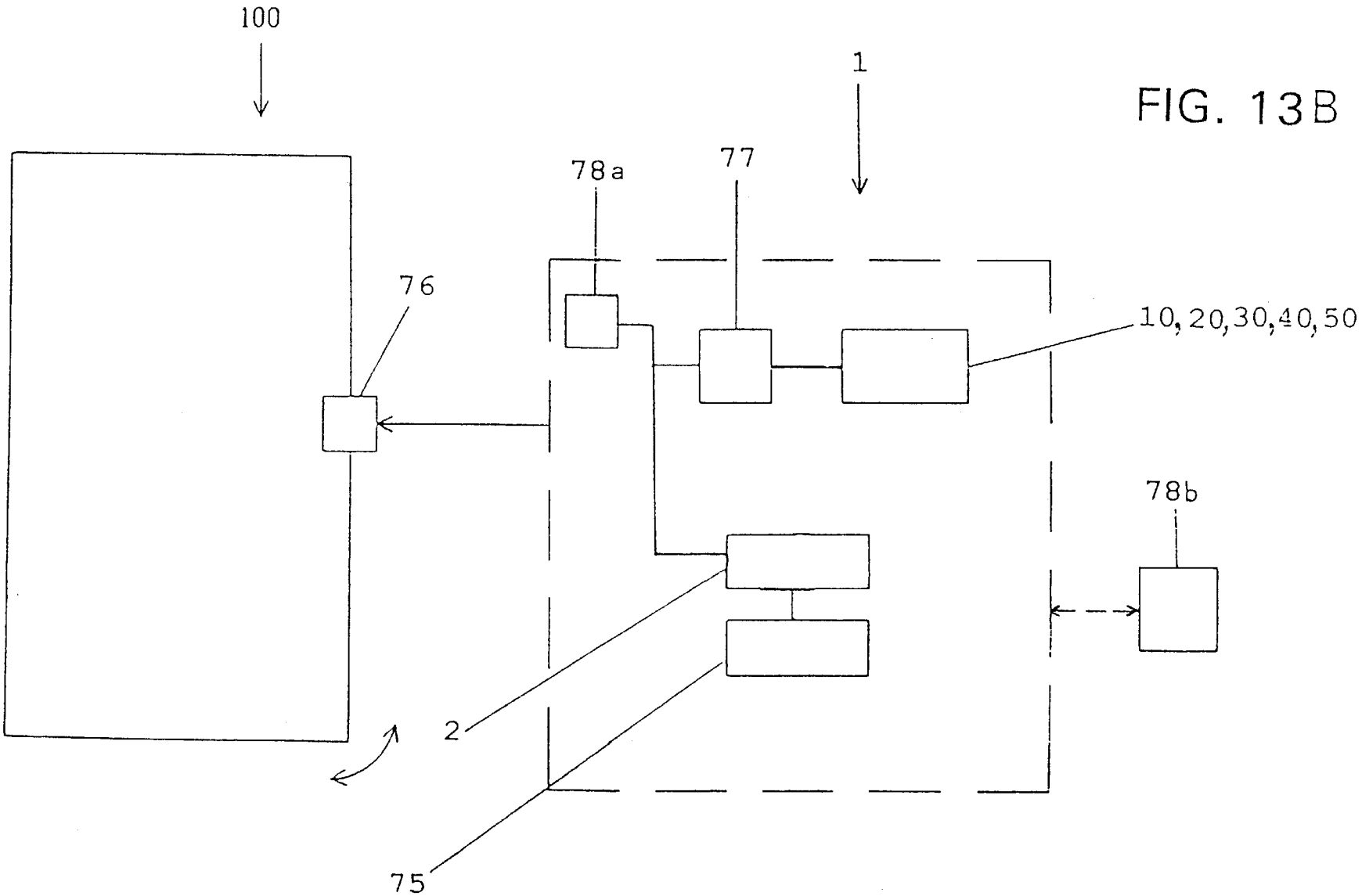
FIG. 13B shows the schematically illustrated security arrangement of FIG. 13A with additional possible components.

FIG. 13B shows schematically additional possible components which could potentially be used with, or added to, at least one embodiment of the present invention, namely, the use of one or more computers or processing units **78*a*, 78*b* in a computer-assisted access control system. That is to say, in at least one embodiment of the present invention, the door terminal 1 can be part of a computer-assisted access control system. Which access control system can record the movements of the door and/or a registration of the user on the basis of the user's user identification. Data can be stored in one or more localized and/or centralized processing units 78*a*, 78*b* (see FIG. 13B**). This data can include a variety of information, including a record or log of all of the door movements, as well including user identification information (which identification information could be in a wide variety of forms, for example, voice recognition, fingerprints, passwords, etc.) which can be used for comparison purposes and for access control determinations and monitoring.

It should be noted that examples of circuitry for, and components and arrangements for, security systems including known security door terminals, some of which circuitry or system components and/or arrangements might be used in conjunction with at least-one embodiment of the present invention can be found in brochures published by DORMA GmbH+Co. KG, including: "Zusatzmodul DORMA ZM 101",WN050561, 10/91, ZM 101, D, 7 B 1/94 Atelier G. Heinz; "Türterminal DORMA TL 62", WN050556, 10/92, _62, D, 7 B 1/94 Atelier G. Heinz; "Zusatzmodul DORMA ZM 102" WN050584, 11/19, ZM102, D, 7 B 1/94, Atelier G. Heinz; and "Zusatzmodul DORMA ZM 201", WN050544, 6/91, ZM201, D, 7 B 1/94, Atelier G. Heinz.

Figure 14A:
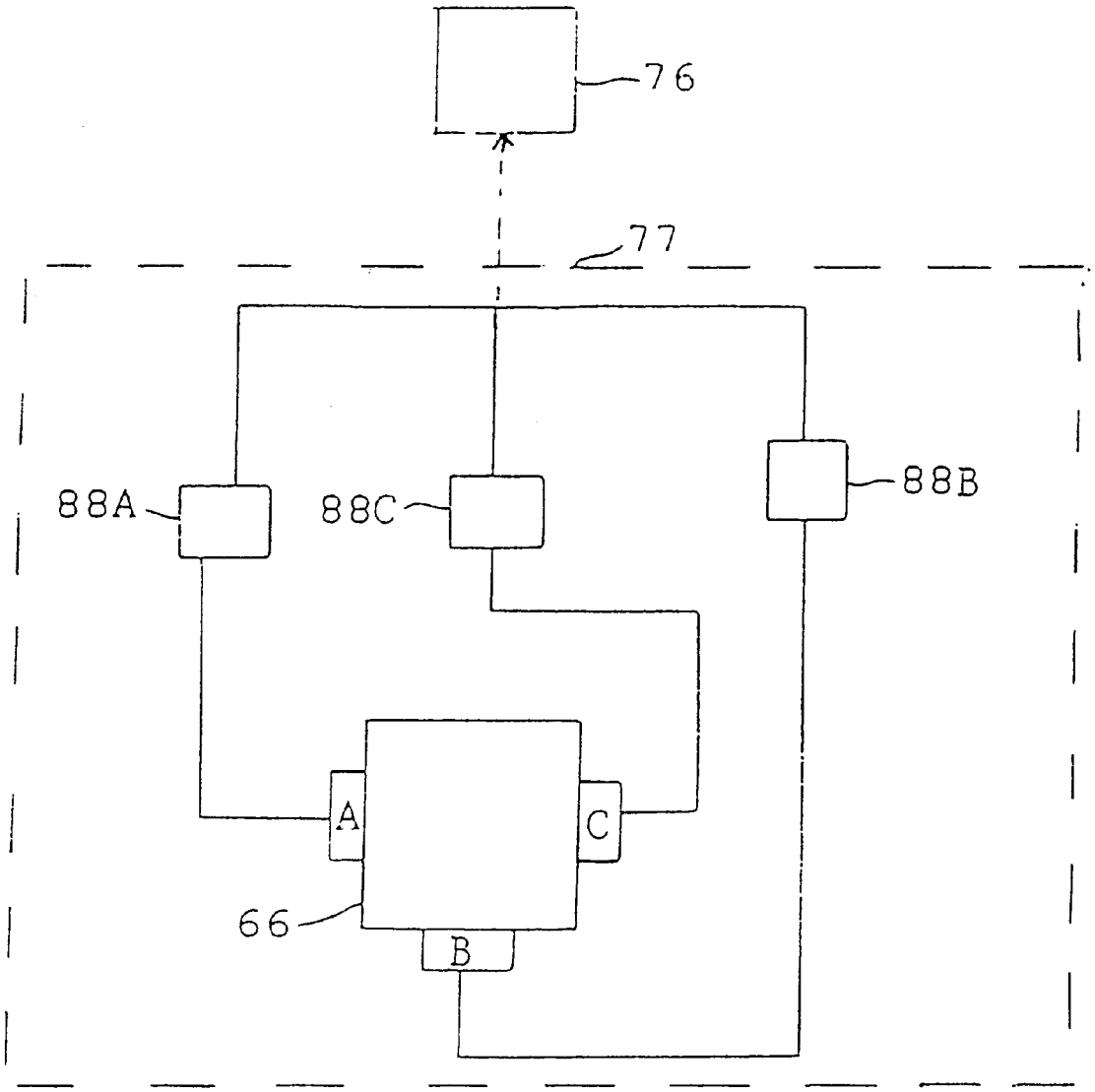
FIGS. 14A is a schematic illustration with more details of possible components shown in FIG. 13A.

FIG. 14A shows a schematic diagram depicting more detail as to one possible embodiment of the socket unit 66, and one possible embodiment of the circuitry 77. This figure shows the socket unit 66 can have electrical contact areas A, B, C, which contact areas A, B, C could possibly each correspond a different modular insert 10, 20, 30, for example, with each insert possibly having only a contact area corresponding to a specific one or area of these contact areas A, B, C, depending upon the type of modular insert it is (e.g., key card, key, keypad, etc.). Or, in one possible embodiment, different combinations of these contact areas A, B, C could correspond to each insert 10, 20, 30, 40, 50. In another possible embodiment, the number of these contact areas A, B, C could vary, depending upon the desired number of inserts the system is designed to interchange. These contacts areas A, B, C, etc., can be substantially directly electrically connected with the locking device 76, or optional interface apparatus 88A, 88B, 88C could be employed.

Figure 14B:
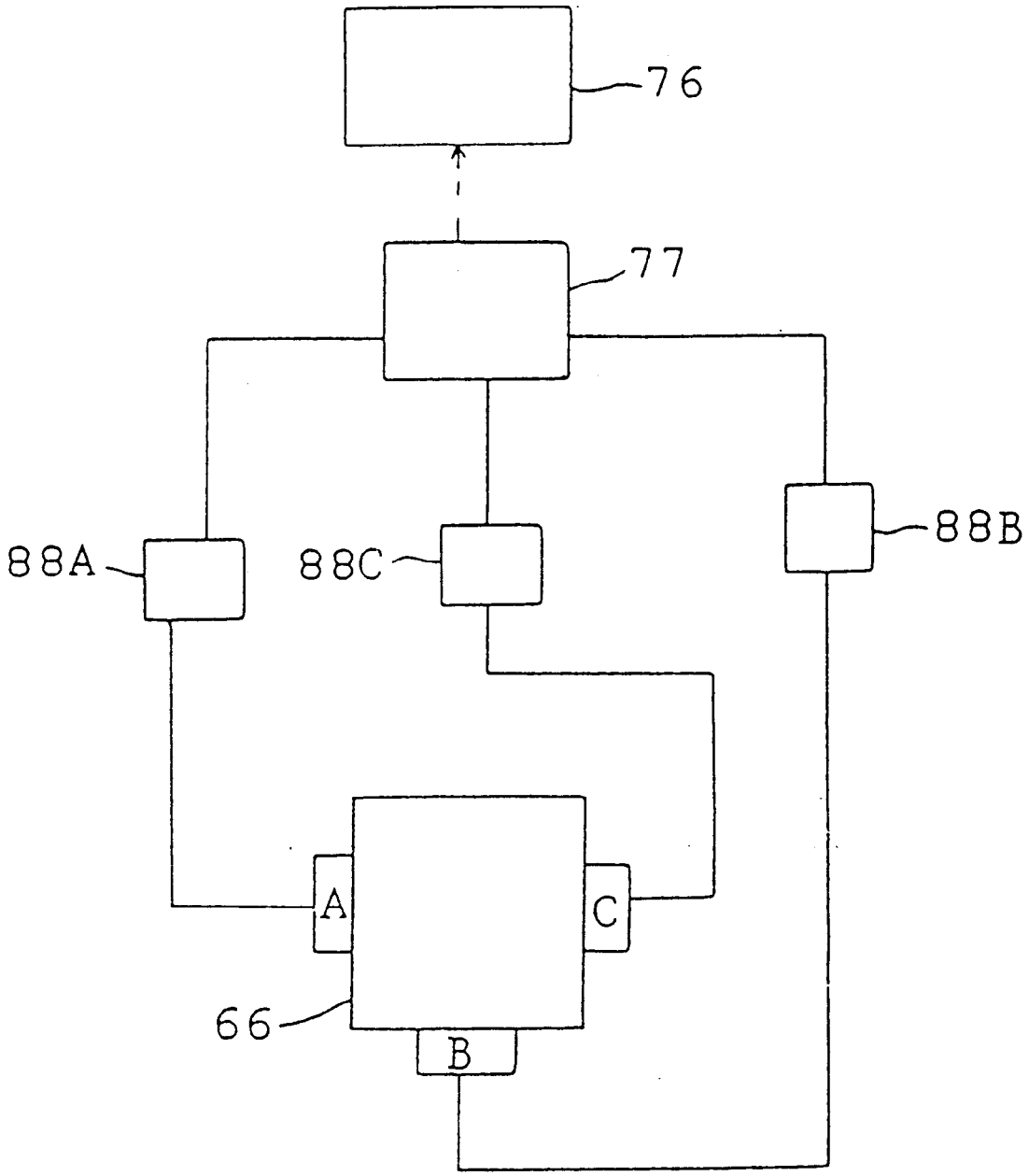
FIG. 14B is a schematic illustration illustrating possible additional system components.

FIG. 14B is similar to FIG. 14A, with the exception that the contact areas A, B, C could be configured separate from, yet electrically connected to circuitry 77, which circuitry 77 could be in communication with the locking device 76. Once again optional interface apparatus 88A, 88B, 88C could be employed. In another possible embodiment the modular inserts 10, 20, 30, 40, 50 might have the same contact areas, but the system might be designed such that a sensor is in place, and/or a signal is sent, which sensor and/or signal enables the system to identify what type of modular insert is plugged-in.

Figure 15:
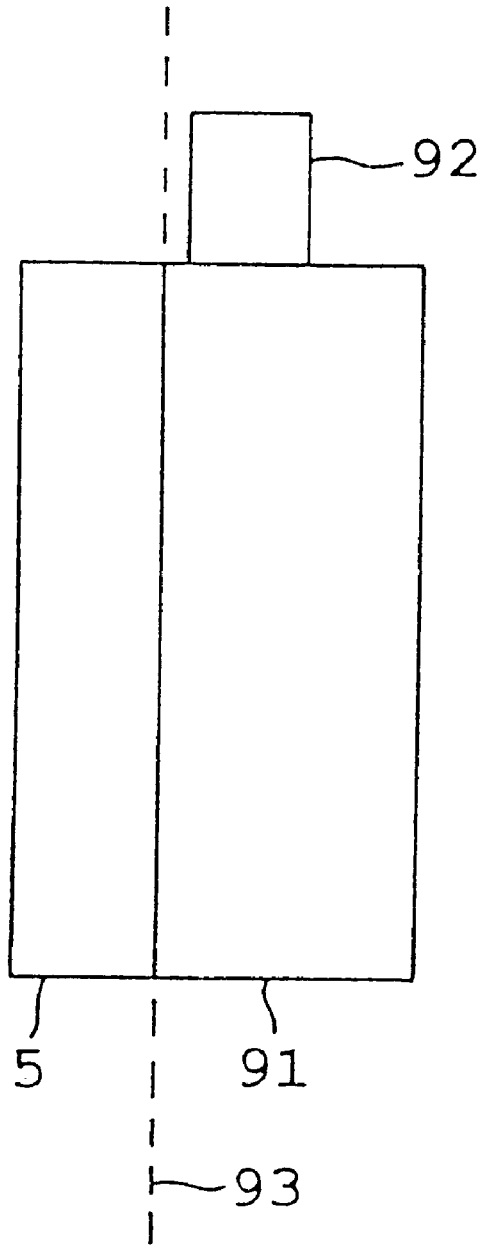
FIG. 15 shows schematically one possible housing mounting arrangement.

FIG. 15 shows schematically one possible mounting arrangement wherein the housing 5 is attached to a mounting base 91, which can be positively and/or non-positively connected to a wall 93, and which can be protected by an essentially tamper-proof contact 92. That is to say, that the base 91 can, be positively connected (for example by screws or bolts), and/or non-positively (for example, biased or frictionally inserted) onto or into the wall 93. However, FIG. 15 shows just one possible mounting arrangement, since the housing 5 can potentially be mounted in a number of different manners, including with a recessed installation of the housing 5.

To further explain, the present invention relates to a security door terminal with a safety emergency open button, in which modular interchangeable inserts can be inserted in a base module by means of plug-in connectors.

Figure 16:
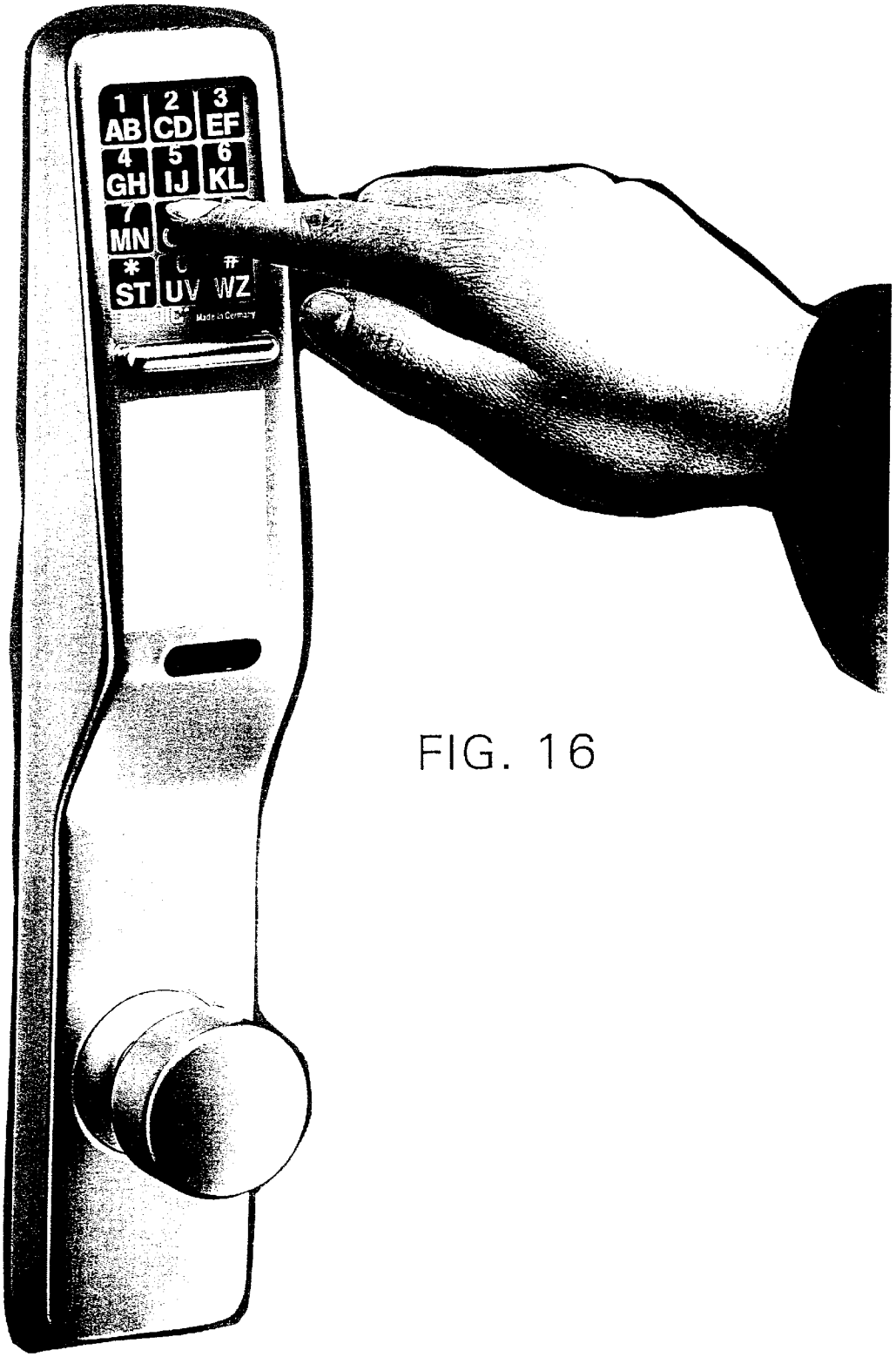
FIG. 16 shows a door lock with a doorknob into which a possible embodiment of the invention may be incorporated.

FIG. 16 shows a door lock with a doorknob into which a possible embodiment of the invention may be incorporated.

Figure 17:
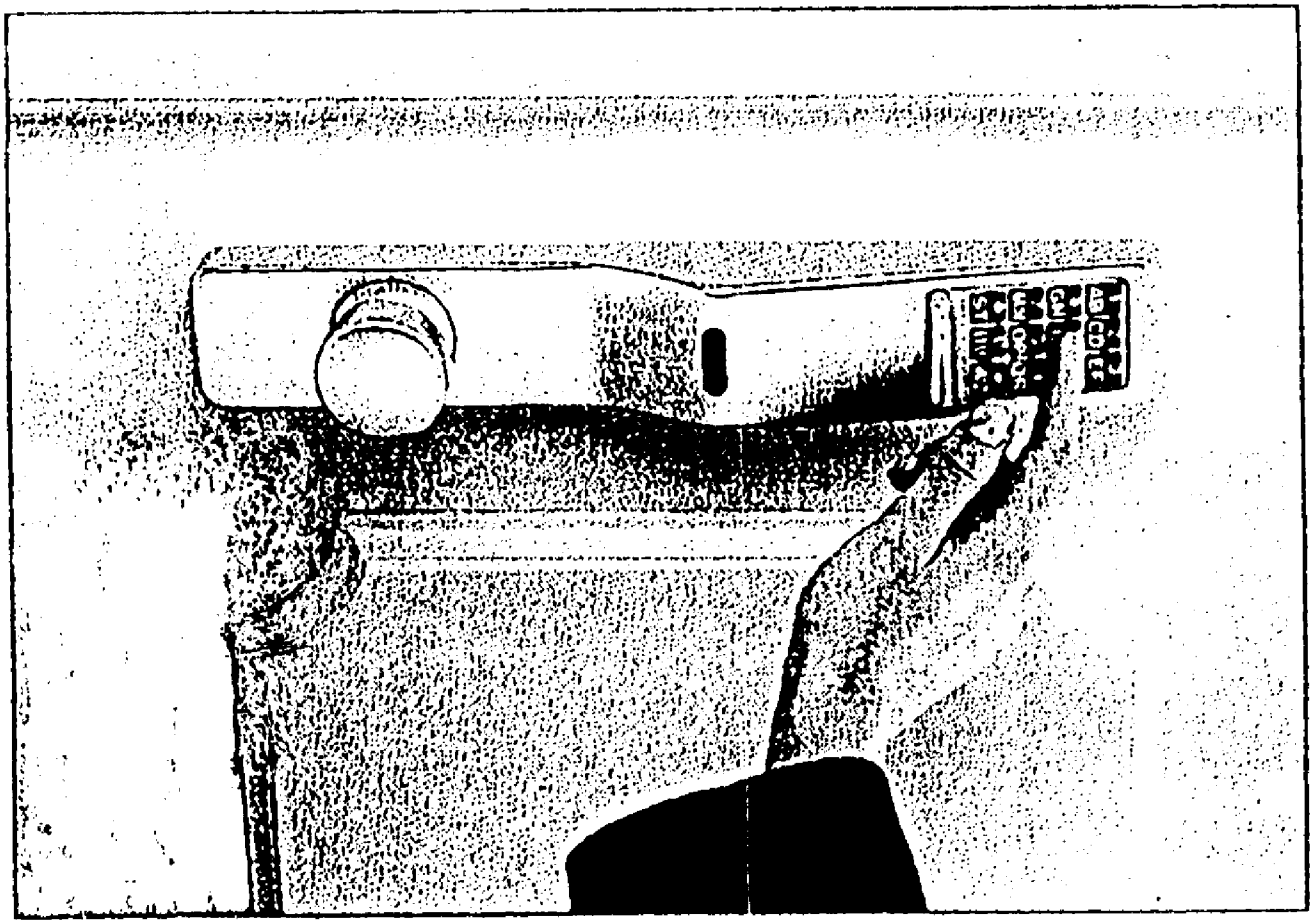
FIG. 17 shows a door lock with a doorknob into which another possible embodiment of the invention may be incorporated.

FIG. 17 shows a door lock with a doorknob into which another possible embodiment of the invention may be incorporated.

Figure 18:
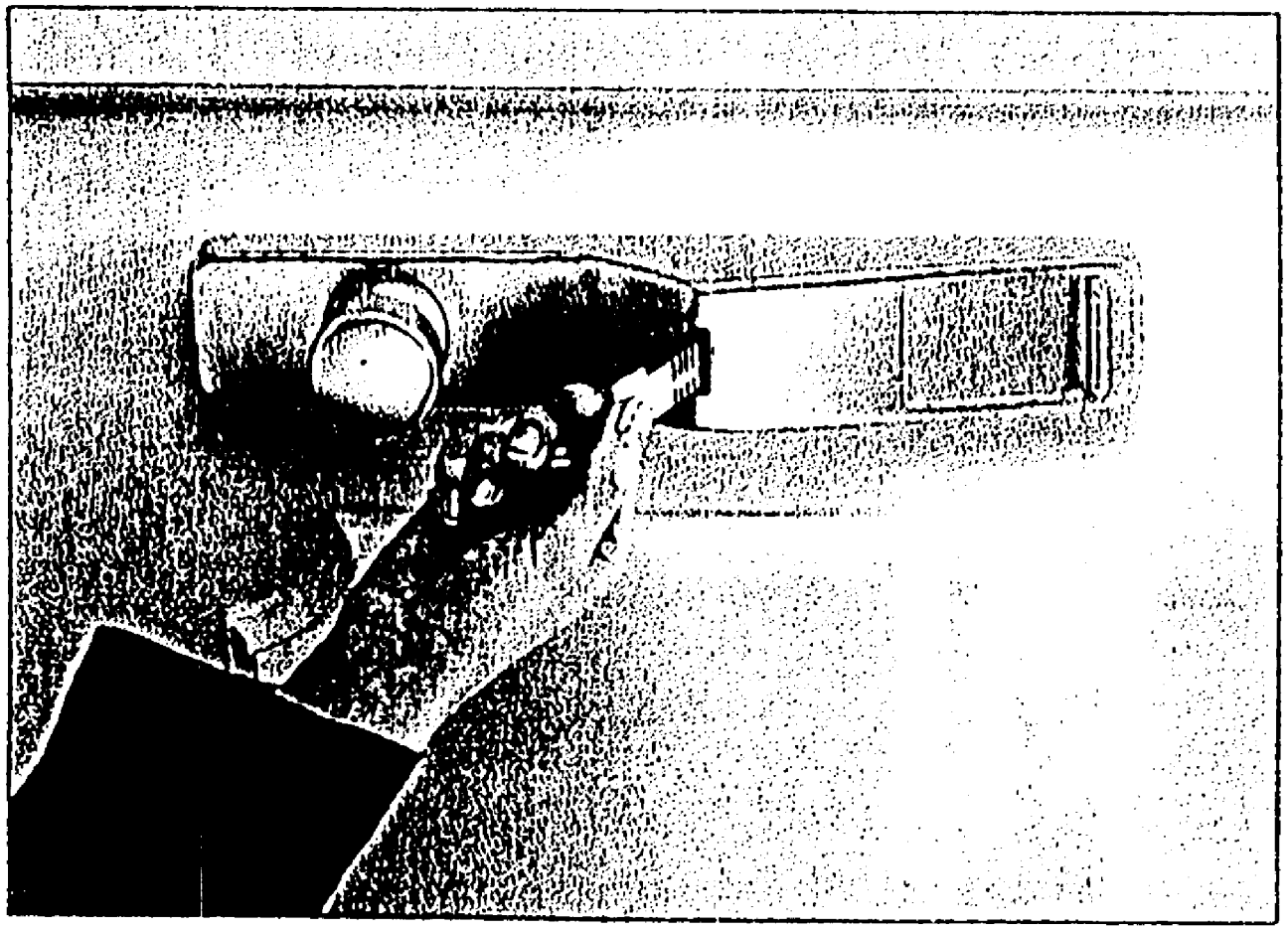
FIG. 18 shows a door lock with a doorknob into which yet another possible embodiment of the invention may be incorporated.

FIG. 18 shows a door lock with a doorknob into which yet another possible embodiment of the invention may be incorporated.

Figure 19:
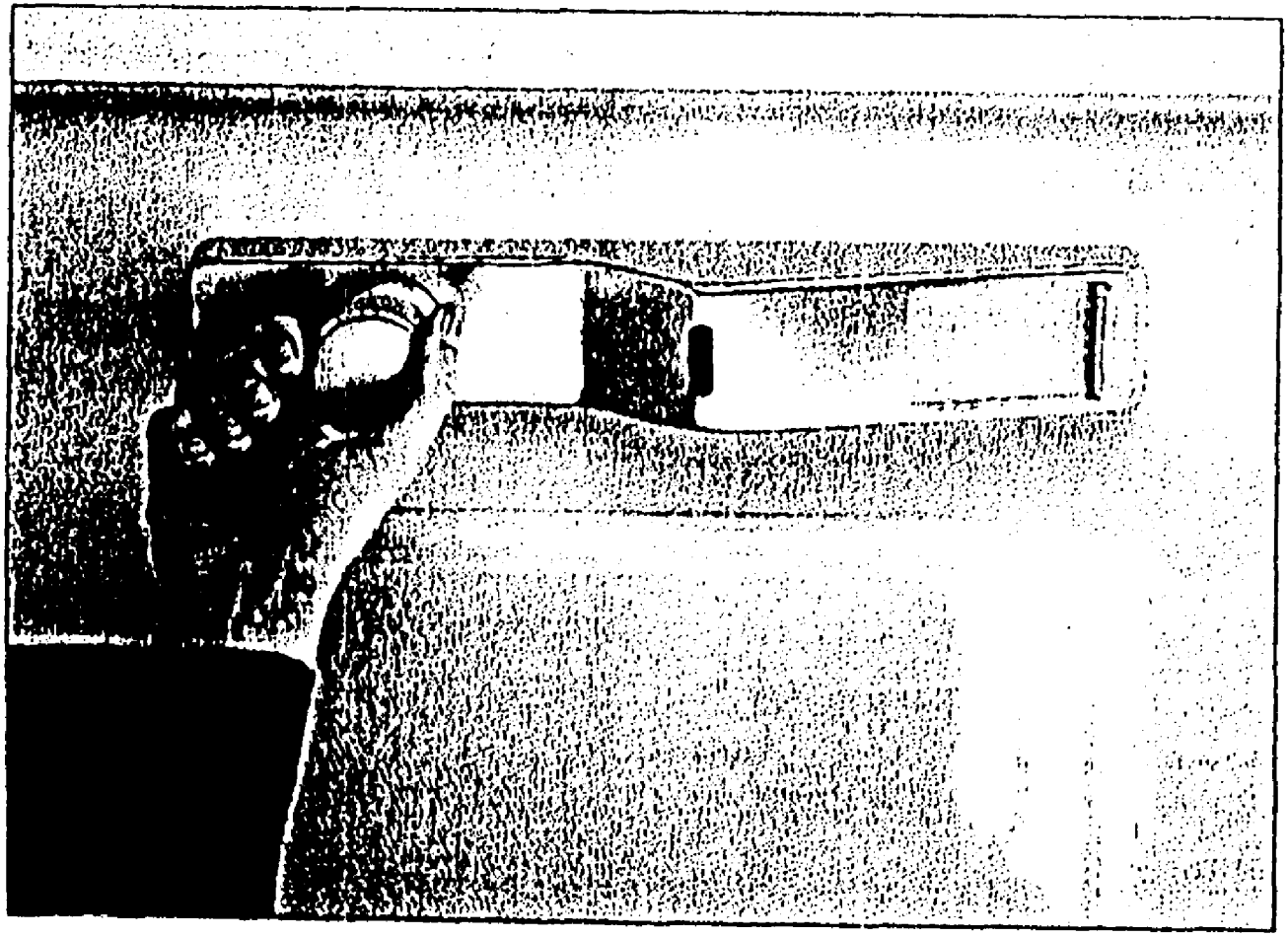
FIG. 19 shows a door lock with a doorknob into which still another possible embodiment of the invention may be incorporated.

FIG. 19 shows a door lock with a doorknob into which still another possible embodiment of the invention may be incorporated.

Figure 20:
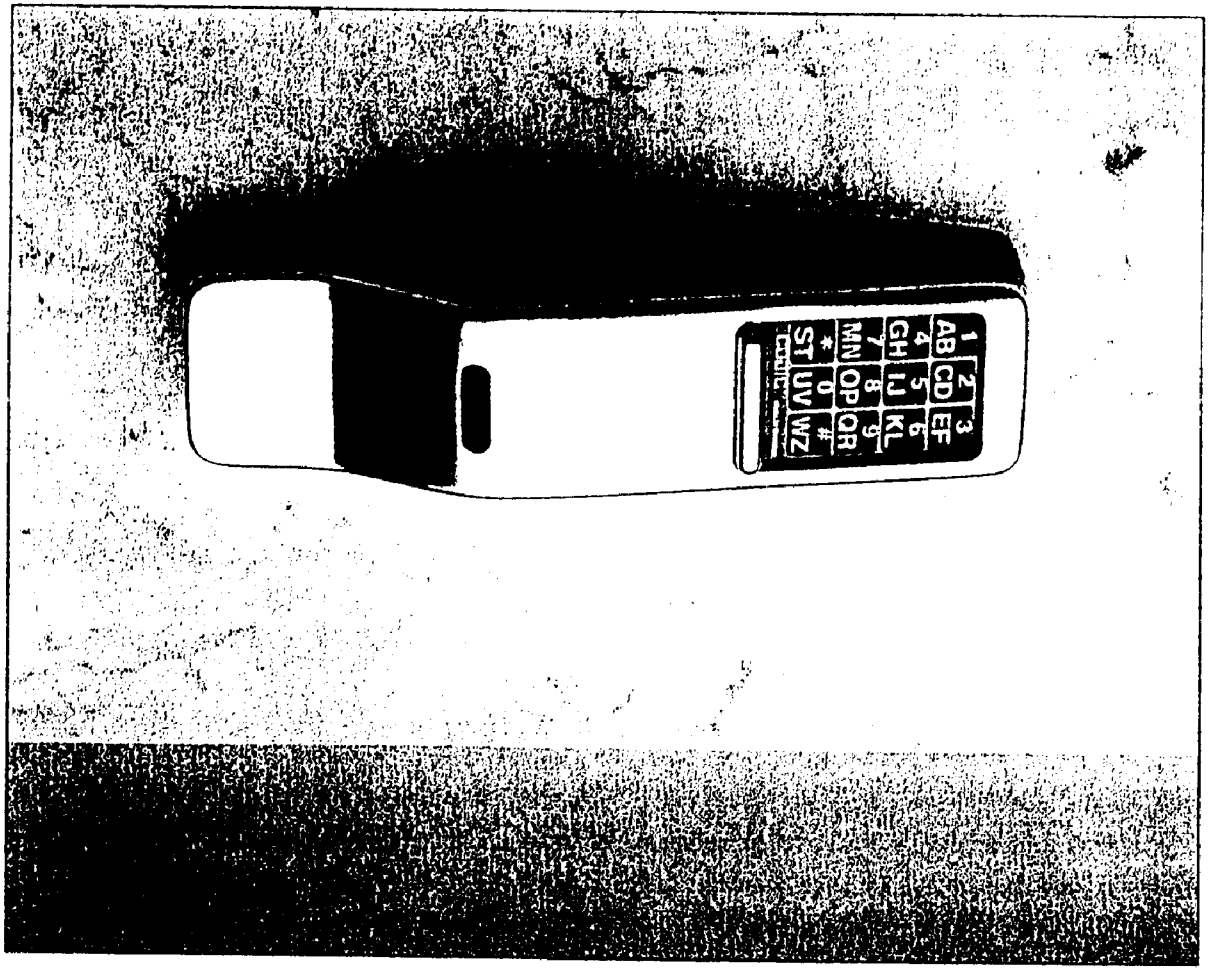
FIG. 20 shows a door lock structure into which a further possible embodiment of the invention may be incorporated.

FIG. 20 shows a door lock structure into which a further possible embodiment of the invention may be incorporated.

Figure 21:
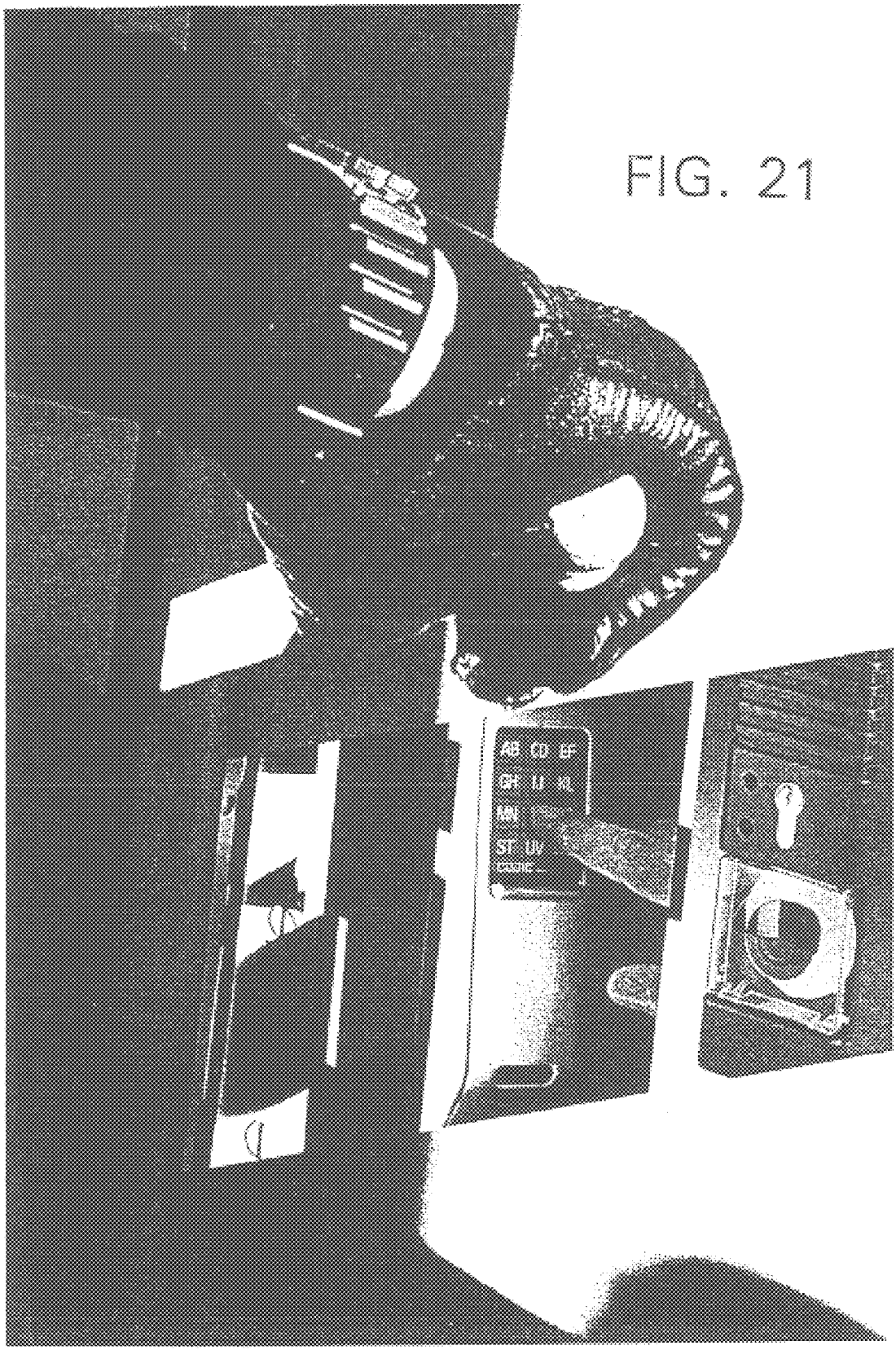
FIG. 21 shows a door lock system into which a possible embodiment of the invention may be incorporated.

FIG. 21 shows a door lock system into which a possible embodiment of the invention may be incorporated.

To better explain the background information hereinabove, one example of a similar known security terminal is the one that is marketed under the name DORMA TL-40. In a stationary housing installed in the vicinity of the door, there is a profile cylinder as defined in DIN 18 252, which is used to deactivate the alarm and to release/disarm the door. Light-emitting diodes (LEDs) are also integrated into the housing to indicate whether the operating status is "secured/unsecured." In the housing, there are also a siren and an emergency open button, as well as c forced-opening switching module as specified by VDE 0660. The housing, which is attached to a base that is firmly anchored on the wall, is protected by a tamper-proof contact. The emergency open button is provided with a non-shattering or shatterproof protective cover made of plastic to prevent unintentional actuation.

An authorized person inserts his or her key into the profile cylinder lock, whereby the "unsecured" operating condition is initiated and the door can be opened. Following a specifiable period of time, the security terminal is automatically reset to the "secured" operating status. In the event of an emergency, the protective cover can be broken by a strong blow, which simultaneously presses the emergency open button, and the door can be opened without resistance, although an alarm is simultaneously tripped.

In large structures, it is frequently necessary to monitor authorized access on many doors. In the security door terminals of the known art as described above, this monitoring is performed by means of the safety EMERGENCY OPEN button, whereby authorized access always requires the insertion of the key.

The known art also includes microcomputer-assisted electronic access control systems which have a keypad and/or an electronic code lock. The brochure entitled "CODIC—die Zutrittskontrolle, die elektronische Intelligenz in perfekter Weise mit mechanischem Schutz verbindet" ["CODIC—The access control system that perfectly combines electronic intelligence and mechanical protection"] published by DORMA GmbH+Co. KG describes a lock that is equipped with a keypad. This type of system can of course be designed to take account of the increasing need for graduated security classes (levels of access), although the cost and complexity for the manufacturer of such access systems increase accordingly with regard to the maintenance of an inventory, spare parts and service. Such microcomputer-assisted electronic access control systems cannot be used on doors located in escape routes because they do not have an emergency open button.

The invention further relates to a security terminal with a housing which is installed on an installation base. The terminal can also have a profile cylinder insert contained inside the housing, and a safety emergency open button which is covered by a protective cover. This EMERGENCY OPEN button is in communication with a switching module which releases a locking device. There also is an electronic circuit, the wiring of which is designed so that various interchangeable modular inserts can be inserted by means of plug-in connections to allow access to authorized persons.

One feature of the invention resides broadly in the door terminal-with a housing 5 which is installed on an installation base, a profile cylinder insert 11 contained inside the housing 5, and a safety emergency open button 2 which is covered by a protective cover 4, whereby the emergency open button 2 is in communication with a switching module which releases a locking device, and there is an electronic circuit, the wiring of which is designed so that various interchangeable modular inserts 10, 20, 30, 40, 50 can be inserted by means of plug-in connections to allow access to authorized persons.

Another feature of the invention resides broadly in the door terminal characterized by the fact that the insert 10 has a profile cylinder 11.

Yet another feature of the invention resides broadly in the door terminal characterized by the fact that the insert 20 has a round cylinder 21.

Still another feature of the invention resides broadly in the door terminal characterized by the fact that the insert 30 has an electronic code lock 31 that is opened by a mechanical code key.

A further feature of the invention resides broadly in the door terminal characterized by the fact that the insert 40 has an electronic code lock 41 that is opened by a keypad.

Another feature of the invention resides broadly in the door terminal characterized by the fact that the insert 50 has a sensor system 51 that is based on transponder technology.

Yet another feature of the invention resides broadly in the door terminal characterized by the fact that the door terminal 1 is part of a computer-assisted access control system.

Still another feature of the invention resides broadly in the door terminal characterized by the fact that the computer-assisted access control system records all the movements of the door.

A further feature of the invention resides broadly in the security access control system characterized by the fact that all the movements of the doors to be controlled are recorded, along with a registration of the user on the basis of the user's user identification.

Another feature of the invention resides broadly in the a plurality of barriers in a structure, each said barrier comprising: locking apparatus; said locking apparatus having at least a first position for unlocking said barrier, and a second position for locking said barrier; a control arrangement; said control arrangement comprising: a housing unit; a plurality of alternatively interchangeable plug-in inserts; said plurality of alternatively interchangeable plug-in inserts each comprising a connection portion; said plurality of plug-in inserts each being configured to permit access through its corresponding barrier upon an authorized manifestation; said housing unit being configured to interchangeably receive said connection portion of all of said plurality of plug-in inserts, one insert at a time; said plurality of plug-in inserts comprising at least a first plug-in insert and a second plug-in insert; said first plug-in insert being different than said second plug-in insert; said plurality of plug-in inserts being configured to operatively connect to said locking apparatus; said housing unit comprising: an arrangement to permit said interchangeability of said plurality of plug-in inserts; an emergency open device to permit the opening of its corresponding barrier in the event of an emergency condition; a protective cover; said protective cover being disposed to cover said emergency open device; apparatus to release said locking apparatus; and said emergency open device being operatively connected to said releasing apparatus to unlock said barrier.

Yet another feature of the invention resides broadly in the plurality of barriers wherein: said control arrangement comprises a base member; and said housing unit is installed on said base member.

Still another feature of the invention resides broadly in the plurality of barriers wherein: said apparatus to unlock said locking apparatus comprises a module.

A further feature of the invention resides broadly in the plurality of barriers wherein: said arrangement to permit said interchangeability of said plurality of plug-in inserts comprises a configuration to permit said interchangeability.

Another feature of the invention resides broadly in the a method for installing a plurality of barriers in a structure, each said barrier comprising: locking apparatus; said locking apparatus having at least a first position for unlocking said barrier, and a second position for locking said barrier; a control arrangement; said control arrangement comprising: a housing unit; a plurality of alternatively interchangeable plug-in inserts; said plurality of alternatively interchangeable plug-in inserts each comprising a connection portion; said plurality of plug-in inserts each being configured to permit access through its corresponding barrier upon an authorized manifestation; said housing unit being configured to interchangeably receive said connection portion of all of said plurality of plug-in inserts, one insert at a time; said plurality of plug-in inserts comprising at least a first plug-in insert and a second plug-in insert; said first plug-in insert being different than said second plug-in insert; said plurality of plug-in inserts being configured to operatively connect to said locking apparatus; said housing unit comprising: an arrangement to permit said interchangeability of said plurality of plug-in inserts; an emergency open device to permit the opening of its corresponding barrier in the event of an emergency condition; apparatus to release said locking apparatus; and said emergency open device being operatively connected to said releasing apparatus to unlock said barrier, said method for installing a plurality of barriers comprising the steps of: determining which of the barriers require controlled access therethrough; installing a corresponding control arrangement for each of the determined barriers to control the access through said determined barriers; said step of installing the control arrangements comprising: mounting one of the housing units at each of the determined barriers; determining the authorized manifestation desired at each of the determined barriers; choosing a plug-in insert from the plurality of plug-in inserts configured to permit access upon the desired authorized manifestation, for each the determined barrier; the chosen plug-in inserts comprising control functions corresponding to the authorized manifestations; and plugging a chosen plug-in insert into each of the housing units corresponding to each of the determined barriers to achieve the desired control function at each of the determined barriers.

Yet another feature of the invention resides broadly in the method wherein for each determined barrier: the housing unit comprise a protective cover; the protective cover being disposed to cover the emergency open device; the control arrangement comprises a base member; and the housing unit is installed on the base member.

Still another feature of the invention resides broadly in the method wherein: the arrangement to permit said interchangeability of said plurality of plug-in inserts comprises an electronic circuit configured to permit said interchangeability; and the apparatus to release said locking apparatus comprises a switching module.

A further feature of the invention resides broadly in the method wherein said plurality of plug-in inserts each comprise one of A), B), C), D), and E): A) a profile cylinder; the profile cylinder is configured to be opened by a key; B) a round cylinder; the round cylinder is configured to be opened by a key; C) an electronic code lock; the electric code lock is configured to be opened by a mechanical code key; D) an electronic code lock; a key pad; the electronic code lock is configured to be opened by the keypad; and E) a sensor system comprising transponder technology; the sensor system is configured to be opened by a coded sensor signal.

Another feature of the invention resides broadly in the method wherein: the control arrangement comprises at least one computer to provide computer-assisted access control systems.

Yet another feature of the invention resides broadly in the method wherein said computer-assisted access control system records all the movements of its corresponding barrier.

Still another feature of the invention resides broadly in the method wherein said computer assisted access control system records a registration of the user of said computer assisted access control system on the basis of a user's user identification information stored in the at least one computer.

A further feature of the invention resides broadly in the a control arrangement for controlling access through a barrier, the barrier having a device to lock and unlock the barrier, said control arrangement comprising: a housing unit; a plurality of alternatively interchangeable plug-in inserts; each of said plurality of alternatively interchangeable plug-in inserts comprising a connection portion; said plurality of plug-in inserts each being configured to permit access upon an authorized manifestation; said housing unit being configured to interchangeably receive said connection portion of all of said plurality of plug-in inserts; said plurality of plug-in inserts comprising at least a first plug-in insert and a second plug-in insert; said first plug-in insert being different than said second plug-in insert; said housing unit comprising: an arrangement to permit said interchangeability of said plurality of plug-in inserts; an emergency open device to permit the opening of the barrier in the event of an emergency condition; apparatus to release the device to lock and unlock the barrier; and said emergency open device being operatively connected to said releasing apparatus.

Another feature of the invention resides broadly in the control arrangement according to claim 12, wherein: said housing unit comprises a protective cover; and said protective cover being disposed to cover said emergency open device.

Yet another feature of the invention resides broadly in the control arrangement wherein: said control arrangement comprises a base member; and said housing unit is installed on said base member.

Still another feature of the invention resides broadly in the control arrangement wherein the barrier through which access is controlled is a door, and wherein: said arrangement to permit said interchangeability of said plurality of plug-in inserts comprises an electronic circuit configured to permit said interchangeability.

A further feature of the invention resides broadly in the control arrangement wherein said apparatus to release said locking apparatus comprises a switching module.

Another feature of the invention resides broadly in the control arrangement wherein said plurality of plug-in inserts each comprise one of A), B), C), D), and E): A) a profile cylinder; said profile cylinder is configured to be opened by a key; B) a round cylinder; said round cylinder is configured to be opened by a key; C) an electronic code lock; said electric code lock is configured to be opened by a mechanical code key; D) an electronic code lock; a key pad; said electronic code lock is configured to be opened by said keypad; and E ) a sensor system comprising transponder technology; said sensor system is configured to be opened by a coded sensor signal.

Yet another feature of the invention resides broadly in the control arrangement wherein said control arrangement comprises at least one computer to provide a computer-assisted control arrangement.

Still another feature of the invention resides broadly in the control arrangement wherein said computer-assisted control arrangement records all the movements of its corresponding door.

A further feature of the invention resides broadly in the control arrangement wherein said computer-assisted control arrangement records a registration of the user of said computer assisted access control system on the basis of a user's user identification information stored in said at least one computer.

The International Application No. PCT/EP97/06990, filed on Dec. 12, 1997, which claims priority from Federal Republic of Germany Patent Application No. DE 196 52 348.6, filed on Dec. 17, 1996, is incorporated by reference herein. The U.S. was an elected state in International Application No. PCT/EP97/06990.

The following documents contain examples of security terminals and/or components or devices that may be used in or with security terminals, which may be used in or in conjunction with at least one embodiment of the present invention: U.S. Pat. No. 5,337,043 issued on Aug. 9, 1994 to A. Gokcebay; Federal Republic of Germany Pat. No. DE 295 10 880 U1, published on Jul. 11, 1996; Federal Republic of Germany Patent No. DE 195 31 323 A1, published on Apr. 18, 1996, inventor J. Rothenburg; Federal Republic of Germany Pat. No. DE 295 00 196.8 published on May 18, 1995; Federal Republic of Germany Pat. No. DE 40 17 934 C2, published on Jan. 2, 1992; International Patent Application No. PCT/CH89/00070, filed on Apr. 12, 1989, entitled "Electric Transmission Device," and corresponding publication WO 89/10651 published on Nov. 2, 1989; International Patent Application No. PCT/US87/02794 filed on Oct. 23, 1997, entitled "Interchangeable Personality Modules for a Computer Terminal," and corresponding publication WO 88/0328 published May 5, 1988; International Patent Application No. PCT/IT91/00100, filed on Nov. 22, 1991, entitled "Safety Lock with Multiple Operation with Emergency Manual Intervention Facility", and corresponding publication WO 92/09773 published Jun. 11, 1992; European Patent No. EP 0 441 237 A1, published on Aug. 14, 1991; U.S. patent application Ser. No. 08/644,537, filed on May 10, 1996, having inventor Gerhard Kirchhoff, entitled (as amended) "Security Structure with Electronic Smart Card Access thereto with Transmission of Power and Data Between the Smart Card and the Smart Card Reader Performed Capacitively or Inductively," which U.S. application claims priority from the Federal Republic of Germany Patent Application No. 44 32 324.7 filed Sep. 13, 1994 and DE 44 32 324.7; the article "Kommunikationstechnik mit Aufgabenzugewinn, published i n "elektrobbrse" dated September 1990; and the following brochures published by DORMA GmbH & Co. KG: "CODIC—die Zutrittskontrolle, die elektronische Intelligenz in perfekter Weise mit mechanischem Schutz verbindet"; "Zusatzmodul DORMA ZM 101",WN050561, 10/91, ZM 101, D, 7 B 1/94 Atelier G. Heinz; "Türterminal DORMA TL 62", WN050556, 10/92, _62, D, 7 B 1/94 Atelier G. Heinz; "Rettungswegzentralen DORMA RZ 01 und RZ 11" WN 050042, 10/88, RZ, D, 7. B. 1/94; Türterminals DORMA TL Typenreihe 40", "Turverriegelung DORMA TV Typenreihe 100"; Steuer-, Anzeige- und Alarmeinrichtungen"; "Zusatzmodul DORMA ZM 102" WN050584, 11/19, ZM102, D, 7 B 1/94, Atelier G. Heinz; and "zusatzmodul DORMA ZM 201", WN050544, 6/91, ZM201, D, 7 B 1/94, Atelier G. Heinz. These documents are hereby incorporated by reference as if set forth in their entirety herein.

International Application No. PCT/EP97/06990 was pending as of the filing date of another application.

Examples of plug-in connections or components or circuitry related thereto which might be used in conjunction with at least one embodiment of the present invention may be found in U.S. Pat. No. : U.S. Pat. No. 5,295,846 issued on Mar. 22, 1994 to Sumida, et al.; U.S. Pat. No. 5,454,730 issued on Oct. 3, 1995 to T. Tozuka; U.S. Pat. No. 5,460,548 issued on Oct. 24, 1995 to M. Roth; U.S. Pat. No. 5,382,176 issued on Jan. 17, 1995 to A. Norden; U.S. Pat. No. 5,383,799 issued on Jan. 24, 1995 to P. Fladung; U.S. Pat. No. 5,385,486 issued on Jan. 31, 1995 to D. Robinson, et al.; U.S. Pat. No. 5,393,942 issued on Feb. 28, 1995 to R. Reiner, et ano; U.S. Pat. No. 5,397,253 issued on Mar. 14, 1995 to H. Fries; U.S. Pat. No. 5,398,405 issued on Mar. 21, 1995 to I. Jasch; U.S. Pat. No. 5,429,525 issued on Jul. 4, 1995 to P. McCoy; U.S. Pat. No. 5,437,564 issued on Aug. 1, 1995 to J. Lignelet; U.S. Pat. No. 5,393,241 issued on Feb. 28, 1995 to M. Honda, et al.; U.S. Pat. No. 3,137,535 issued in Jun. 1964 to Collier et al.; U.S. Pat. No. 4,812,133 issued in March 1989 to Fleak et al.; U.S. Pat. No. 4,915,649 issued in April 1990 to Shimazu et al.; U.S. Pat. No. 4,938,710 issued in July 1990 to Aihara et al.; U.S. Pat. No. 4,842,541 issued in June 1989 to Leandris; U.S. Pat. No. 4,655,527 issued in April 1987 to Van Dame; U.S. Pat. No. 4,593,965 issued in June 1986 to Joly; and U.S. Pat. No. 3,179,738 issued in April 1965 to DeLyon.

Some examples of alarm systems which may be utilized in accordance with the embodiments of the present invention may be found in the following U.S. Pat. No. 5,374,936 entitled "Security System"; U.S. Pat. No. 5,115,224 entitled "Personal Security System Network" to Detection Systems; and U.S. Pat. No. 5,191,314 entitled "Combination Anti-theft Lock and Alarm" to Pacific West Industries.

Some examples of card readers which may be utilized in accordance with one or more embodiments of the present invention may be found in the following U.S. Pat. No. 5,257,414 entitled "Apparatus for Accepting and Retaining a Memory Card" to Motorola; U.S. Pat. No. 5,291,006 entitled "Authenticity Identifying System for Information Storage Cards" to NHK Springs; and U.S. Pat. No. 5,373,146 entitled "Card Based Access System with Reader Updating of the Memory".

Some examples of voice identification systems which may be utilized in accordance with at least one embodiment of the present invention may be found in the following U.S. Pat. No. 5,214,699 entitled "System for Decoding and Displaying Personalized Identification Stored on Memory Storage Device" to Audio Digital Imaging; U.S. Pat. No. 5,241,649 entitled "Voice Recognition Method" to Matsushita; and U.S. Pat. No. 5,268,963 entitled "System for Encoding Personalized Identification for Storage on Memory Storage Devices" to Audio Digital Imaging.

Additional examples of personal identification systems which may be utilized in accordance with embodiments of the present invention may be found in the following U.S. Pat. No. 5,291,560 entitled "Biometric Personal Identification System Based on Iris Analysis"; U.S. Pat. No. 5,187,748 entitled "Optical Apparatus for Fingerprint Identification System" to Goldstar; U.S. Pat. No. 5,210,588 entitled "Fingerprint Identification Apparatus for Enhancing Identification Performance" to Goldstar; and U.S. Pat. No. 5,363,453 entitled "Non-minutiae Automatic Fingerprint Identification System and Methods" to TMS Inc.

Some examples of antennas and transponders which may be utilized in accordance with one or more embodiments of the present invention may be found in the following U.S. Pat. No. 5,347,263 entitled "Electronic Identifier Apparatus and Method Utilizing a Single Chip Microcontroller and an Antenna Coil" to Gnuco; U.S. Pat. No. 5,266,942 entitled "Security System with Memory in Transmitter and Receiver" to Stoller; U.S. Pat. No. 5,371,719 entitled "High Security Ultrasonic Receiver Apparatus" to Sentry; and U.S. Pat. No. 5,185,611 entitled "Compact Antenna Array for Diversity Applications" to Motorola.

Some examples of LEDs and operating indicators which may be utilized in accordance with the present invention may be found in the following U.S. Patent: U.S. Pat. No. 5,216,287 entitled "Electronic, Preferably Zero-contact Switch" to Werner Turck; U.S. Pat. No. 5,268,635 entitled "Intelligent Self-Diagnosing and Sparing Light Emitting Diodes" to AT&T; and U.S. Pat. No. 5,331,333 entitled "Display Apparatus" to Sharp Kabushiki Kaisha.

Some examples of high-strength plastics and metals which may be utilized in accordance with the embodiments of the present invention may be found in the following U.S. Pat. No. 5,229,177 entitled "Multi-directional, Light-weight, High-strength Interlaced Material" to Quadrax; U.S. Pat. No. 5,330,594 entitled "Method of Making Cold Formed High-Strength Steel Parts" to Consolidated Metal Products, Inc.; and U.S. Pat. No. 5,179,244 entitled "Reinforced Soft and Hard Body Armor".

Examples of general components relating to transmitters or receivers which may be utilized in accordance with the embodiments of the present invention, may be found in the following U.S. Patents and other patent publications: U.S. Pat. No. 4,356,477, which issued to Vandebult on Oct. 26, 1982; U.S. Pat. No. 5,321,412, which issued to Kopp et al. on Jun. 14, 1994; Published European Patent Application No. 0 387 970, inventor Fockens (corresponding to U.S. Pat. No. 5,051,727); and Published European Patent Application No. 0 565 481, inventor Kind (corresponding to U.S. Pat. No. 5,349,339).

Other examples of general components relating to transmitters/receivers which may be utilized in accordance with the embodiments of the present invention, may be found in the following U.S. Pat. No. 4,736,207, which issued to Siikarla et al. on Apr. 5, 1988; U.S. Pat. No. 5,109,217, which issued to Siikarla et al. on Apr. 28, 1992; U.S. Pat. No. 4,642,640, which issued to Woolsey et al. on Feb. 10, 1987; U.S. Pat. No. 4,063,229, which issued to Welsh et al. on Dec. 13, 1977; U.S. Pat. No. 4,139,844, which issued to Reeder on Feb. 13, 1979; U.S. Pat. No. 4,352,098, which issued to Stephen et al. on Sep. 28, 1982; U.S. Pat. No. 4,212,002, which issued to Williamson on Jul. 8, 1980; U.S. Pat. No. ,895,368, which issued to Gorden et al. on Jul. 15, 1975; U.S. Pat. No. 5,349,332; U.S. Pat. No. 5,300,922, which issued to Stoffer; and U.S. Pat. No. 4,531,117, which issued to Nourse et al.

Some examples of inductive coupling devices which may be used in conjunction with the present invention are to be found in U.S. Pat. No. 5,377,807, issued to Kojima et al. on Jan. 3, 1995 and entitled "Coin Validator with Optical Coupling"; U.S. Pat. No. 5,396,538, issued to Hong on Mar.

7, 1995 and entitled "Contactless Digital Power Transmission and Reception System in a Radio Telephone"; U.S. Pat. No. 5,423,334, issued to Jordan on Jun. 13, 1995 and entitled "Implantable Medical Device Characterization System"; U.S. Pat. No. 5,426,667, issued to van Zon on Jun. 17, 1993 and entitled "System for the Contactless Exchange of Data, and Responder for Use in such a System"; and U.S. Pat. No. 5,437,277, issued to Dumoulin et al. on Aug. 1, 1995 and entitled "Inductively Coupled RF Tracking System for Use in Invasive Imaging of a Living Body".

Some examples of capacitive coupling devices which may be used in conjunction with the present invention are to be found in U.S. Pat. No. 5,380,320, issued to Morris on Jan. 10, 1995 and entitled "Electrosurgical Instrument having a Parylene Coating"; U.S. Pat. No. 5,383,465, issued to Lesny et al. on Jan. 24, 1995 and entitled "Ultrasonic Instrument"; U.S. Pat. No. 5,394,365, issued to Tsukikawa on Mar. 28, 1995 and entitled "Charge Pump Circuit having an Improved Charge Pumping Efficiency"; U.S. Pat. No. 5,420,806, issued to Shou et al. on May 30, 1995 and entitled "Multiplication Circuit for Multiplying Analog Signals by Digital Signals"; U.S. Pat. No. 5,423,206, issued to Hetzel on Jun. 13, 1995 and entitled "Fluid Flow Apparatus with Capacitive Sensors"; U.S. Pat. No. 5,432,457, issued to Mitzner et al. on Jul. 11, 1995 and entitled "Capacitive and Inductive Coupling Connector"; and U.S. Pat. No. 5,466,892, issued to Howard et al. on Nov. 14, 1995 and entitled "Circuit Boards Including Capacitive Coupling for Signal Transmission and Methods of Use and Manufacture", each of these patents being hereby expressly incorporated by reference herein.

Some examples of smart cards and key cards which may be used in conjunction with at least one embodiment of the present invention are to be found in U.S. Pat. No. 5,198,643, issued to Miron et al. on Mar. 30, 1993 and entitled "Adaptable Electronic Key and Lock System"; U.S. Pat. No. 5,204,663, issued to Lee on Apr. 20, 1993 and entitled "Smart Card Access Control System"; U.S. Pat. No. 5,241,161 issued to Zuta on Sep. 31, 1993 and entitled "Smart Card Integrated in a Wristwatch and Having Logic Unit Controlling the Automatic Identification Process and the Data Transfer"; U.S. Pat. No. 5,255,430, issued to Tallaksen on Oct. 26, 1993 and entitled "Method of Assembling a Module for a Smart Card"; U.S. Pat. No. 5,311,396, issued to Steffen on May 10, 1994 and entitled "Smart Card Chip-Based Electronic Circuit"; U.S. Pat. No. 5,331,138, issued to Saroya on Jul. 19, 1994 and entitled "Hybrid Card Reader"; U.S. Pat. No. 5,341,140, issued to Perry on Aug. 23, 1994 and entitled "Transponder System"; U.S. Pat. No. 5,341,428, issued to Schatz on-Aug. 23, 1994 and entitled "Multiple Cross-Check Document Verification System"; U.S. Pat. No. 5,422,634, issued to Okubo on Jun. 6, 1995 and entitled "Locking System Using a Key Including an IC Memory"; U.S. Pat. No. 5,477,041, issued to Miron et al. on Dec. 19, 1995 and entitled "Adaptable Electronic Key and Lock System"; U.S. Pat. No. 5,380,991, issued to Valencia et al. on Jan. 10, 1995 and entitled "Paperless Coupon Redemption System and Method Thereof"; U.S. Pat. No. 5,404,580, issued to Simpson et al. on Apr. 4, 1995 and entitled "Radio Having Memory Means for Storing Radio User Validation Code"; U.S. Pat. No. 5,412,564, issued to Ecer on May 2, 1995 and entitled "System and Method for Diet Control"; U.S. Pat. No. 5,426,701, issued to Herrmann et al. on Jun. 20, 1995 and entitled "Cable Television Converter Box with a Smart Card Connector Underneath"; U.S. Pat. No. 5,436,971, issued to Armbrust et al. on Jul. 25, 1995 and entitled "Method of and Circuit Arrangement for Checking a Smart Card"; U.S. Pat. No. 5,446,266, issued to Beuk et al. on Aug. 29, 1995 and entitled "Security System for an Apparatus"; U.S. Pat. No. 5,461,217, issued to Claus on Oct. 24, 1995 and entitled "Secure Money Transfer Techniques Using Smart Cards"; U.S. Pat. No. 5,470,260, issued to Schwan et al. on Nov. 28, 1995 and entitled "Smart Card Connector"; and U.S. Pat. No. 5,471,045, issued to Geronimi on Nov. 28, 1995 and entitled "Smart Card Locking Process".

Examples of tamper-proof contacts and/or tamper sensors and components thereof, which may be used with at least one embodiment of the present invention may be found in U.S. Pat. No. 5,381,824 issued on Jan. 17, 1995 to Y. Wang and W. Orozco; U.S. Pat. No. 5,431,381 issued on Jul. 11, 1995 to O. Smed; U.S. Pat. No. 5,469,613 issued on Nov. 28, 1995 to C. McMills, et ano.; U.S. Pat. No. 5,408,212 issued on Apr. 18, 1995 to C. Meyers, et al.; U.S. Pat. No. 5,411,534 issued on May 2, 1995 to A. Dieken, et al.; U.S. Pat. No. 5,418,686 issued on May 23, 1995 to A. Dieken, et al.; U.S. Pat. No. 5, 396,215 issued on Mar. 7, 1995 to T. Hinkle; and U.S. Pat. No. 5,463,371 issued on Oct. 31, 1995 to R. Fuller.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 196 52 348.6, filed on Dec. 17, 1996, having inventors Armin Heese and Manfred Kampmann, and DE-OS 196 52 348.6 and DE-PS 196 52 348.6 and International Application No. PCT/EP97/06990, filed on Dec. 12, 1997, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A plurality of doors in a structure, each said door comprising:

locking apparatus;

said locking apparatus having at least a first position for unlocking said door, and a second position for locking said door;

an access arrangement; and said access arrangement comprising:

a housing unit;

a plurality of alternatively interchangeable inserts;

said plurality of alternatively interchangeable inserts each comprising a first part;

said plurality of inserts each being configured to permit access through a corresponding door upon an authorized manifestation;

said housing unit having an insertion opening;

said insertion opening being configured and dimensioned to interchangeably receive said first part of each and every one of said plurality of inserts;

said insertion opening being configured to surround a substantial portion of said first part;

said insertion opening being configured to receive solely one insert at a time;

said plurality of inserts comprising at least a first insert and a second insert;

said first insert being different than said second insert;

said plurality of inserts being configured to be connected to said locking apparatus; and said housing unit comprising:

an arrangement to permit said interchangeability of said plurality of inserts;

an emergency open button to permit the opening of a corresponding door in the event of an emergency condition;

a protective cover;

said protective cover being disposed to cover said emergency open button;

apparatus to release said locking apparatus; and said emergency open button being connected to said releasing apparatus to unlock a corresponding door.

2. The plurality of doors according to claim 1, wherein:

said access arrangement comprises a base member; and said housing unit is installed on said base member.

3. The plurality of doors according to claim 2, wherein:

said arrangement to permit said interchangeability of said plurality of inserts comprises a configuration to permit said interchangeability.

4. The plurality of doors according to claim 3, wherein:

said releasing apparatus comprises a module.

5. The plurality of doors according to claim 4, wherein said plurality of inserts each comprise one of A), B), C), D), and E):

A) a profile cylinder configured to receive a key to permit access through a corresponding door;

B) a round cylinder configured to receive a key to permit access through a corresponding door;

C) an electronic code lock configured to receive a mechanical code key to permit access through a corresponding door;

D) an electronic code lock;

a key pad configured to be used to enter a code;

the electronic code lock is configured to be activated by the entering of a code into said keypad to permit access through a corresponding door; and E) a sensor system configured to be activated by a coded signal to permit access through a corresponding door.

6. The plurality of doors according to claim 5, wherein:

the access arrangement comprises at least one computer;

the access arrangement comprises at least one computer-assisted access control system; and said at least one computer is configured to control said at least one computer-assisted access control system.

7. The plurality of doors according to claim 6, wherein:

said at least one computer-assisted access control system is configured to record all the movements of said plurality of doors.

8. The plurality of doors according to claim 7, wherein:

said at least one computer-assisted access control system is configured to record a registration of the user of said at least one computer-assisted access control system on the basis of a user's user identification information stored in said at least one computer.

* * * * *